US007917057B2

(12) United States Patent
Koyanagi et al.

(10) Patent No.: US 7,917,057 B2
(45) Date of Patent: Mar. 29, 2011

(54) IMAGE FORMING APPARATUS WITH A FRONT COVER HAVING A RELEASE MEMBER DISPOSED TO AVOID INCORRECT OPERATION

(75) Inventors: Tsuyoshi Koyanagi, Osaka (JP); Kenichi Mukai, Osaka (JP)

(73) Assignee: Kyocera Mita Corporation (JP)

( * ) Notice: Subject to any disclaimer, the term of this patent is extended or adjusted under 35 U.S.C. 154(b) by 468 days.

(21) Appl. No.: 12/061,776

(22) Filed: Apr. 3, 2008

(65) Prior Publication Data

US 2008/0253802 A1 Oct. 16, 2008

(30) Foreign Application Priority Data

Apr. 13, 2007 (JP) ..... 2007-105666
May 22, 2007 (JP) ..... 2007-134915
Jun. 13, 2007 (JP) ..... 2007-155930

(51) Int. Cl.
*G03G 15/00* (2006.01)

(52) U.S. Cl. ..... 399/110; 399/124

(58) Field of Classification Search ..... 399/110, 399/114, 107, 124
See application file for complete search history.

(56) References Cited

U.S. PATENT DOCUMENTS 7,460,814 B2 * 12/2008 Ito ..... 399/124
2002/0061212 A1 * 5/2002 Tanaka ..... 399/379

FOREIGN PATENT DOCUMENTS

JP 03044653 A * 2/1991
JP 04072230 A * 3/1992
JP 05088422 A * 4/1993
JP 2002-351282 12/2002

* cited by examiner

*Primary Examiner* — Quana M Grainger
(74) *Attorney, Agent, or Firm* — Gerald E. Hespos; Michael J. Porco

(57) ABSTRACT

An image forming apparatus includes an image forming unit, a sheet conveyor and a main body that houses the image forming unit and the sheet conveyor. An operating unit is mounted to a front cover that can move between a closed position to cover an anterior side of the main body and an open position to expose a part of the main body. A retention mechanism retains the front cover at the closed position. The retention mechanism has a lock and a release. The lock is supported by one of the apparatus main body and the front cover and is selectively engageable with and detachable from the other. The release releases engagement of the lock, and is installed posterior to the operating unit in a region facing a back surface as viewed from an opening and closing direction of the front cover.

18 Claims, 17 Drawing Sheets

IMAGE FORMING APPARATUS WITH A FRONT COVER HAVING A RELEASE MEMBER DISPOSED TO AVOID INCORRECT OPERATION

BACKGROUND OF THE INVENTION

1. Field of the Invention

The present invention relates to an image forming apparatus having a front cover in a freely openable/closable manner, which opens, for example, when a treatment for paper jam is carried out, at an anterior surface of the image forming apparatus.

2. Description of the Related Art

In an image forming apparatus such as a printer, a copier, or a facsimile machine, a sheet is conveyed by a sheet conveying section, and an image is formed on the sheet in an image forming unit. For example, in a case in which an image forming apparatus is an electrophotographic system image forming apparatus commonly used for offices and the like, at the time of paper feeding to send away a sheet stacked in a paper feed cassette, or at the time of fixing a transferred toner image transferred onto a sheet by heating and pressuring it, sheet jam is easy to be caused. Therefore, in an image forming apparatus, an opening and closing cover in an openable/closable manner is provided to a front surface or a left or right side surface, and in a case of paper jam, the opening and closing cover is opened to exposure a part of a sheet conveying path, which makes it possible to easily remove the jammed paper.

The opening and closing cover is usually locked with the image forming apparatus main body with a lock member. By releasing this lock member by pushing or pulling release members such as levers or buttons by an operator (a user, a service man, or the like), the opening and closing cover is opened.

Conventionally, such a release member is, in order for anyone to easily find it when paper jam is caused, generally disposed at a relatively prominent portion of a front surface side or a side surface of the image forming apparatus, and so as to be easy to operate, for example, as disclosed in Japanese Unexamined Patent Publication (Kokai) No. 2002-351282.

However, according to the conventional art, because the release member is disposed so as to be prominent and easy to operate for an operator, as a first problem, there is the risk that, for example, when the operator takes a sheet after image formation out of a paper discharge tray, the operator touches the release member by mistake, or touches the release member without discretion, to carry out an incorrect operation. Further, a second problem that the release member is disposed at a place easy to be viewed so as to be prominent from the operator, which spoils the beauty thereof, will be brought about.

SUMMARY OF THE INVENTION

An object of the present invention is to provide an image forming apparatus having a release member which is disposed at a place hard to be viewed from an operator operating the image forming apparatus, and hard to be operated in error, but is easy to operate in case of need of operation.

An image forming apparatus according to an aspect of the present invention to achieve the object, comprising: an image forming unit which forms an image on a sheet; a sheet conveying section which conveys the sheet on which the image is formed; an apparatus main body in which the image forming unit and the sheet conveying section are installed; an operating unit to input operational information; a front cover to which the operating unit is mounted to be supported in a freely openable/closable manner by the apparatus main body, the front cover is capable of changing in position between a closed position to cover an anterior surface side of the apparatus main body and an open position to expose a part of the apparatus main body; and a retention mechanism which includes a lock member and a release member, the retention mechanism retains the front cover at the closed position with respect to the apparatus main body, wherein the lock member is a member which is supported by one of the apparatus main body and the front cover so as to be capable of making an engagement with and being detached from the other one, and the release member is a member to release engagement of the lock member, and the release member is installed at a region located posterior to the operating unit and a region facing a back surface side as viewed from an opening and closing direction of the front cover.

BRIEF DESCRIPTION OF THE DRAWINGS

FIG. 9A is a diagram illustrating closed positions (closed states) of the both, and FIG. 9B is a diagram illustrating open positions (open states) thereof.

DETAILED DESCRIPTION OF THE PREFERRED EMBODIMENTS

Figure 1:
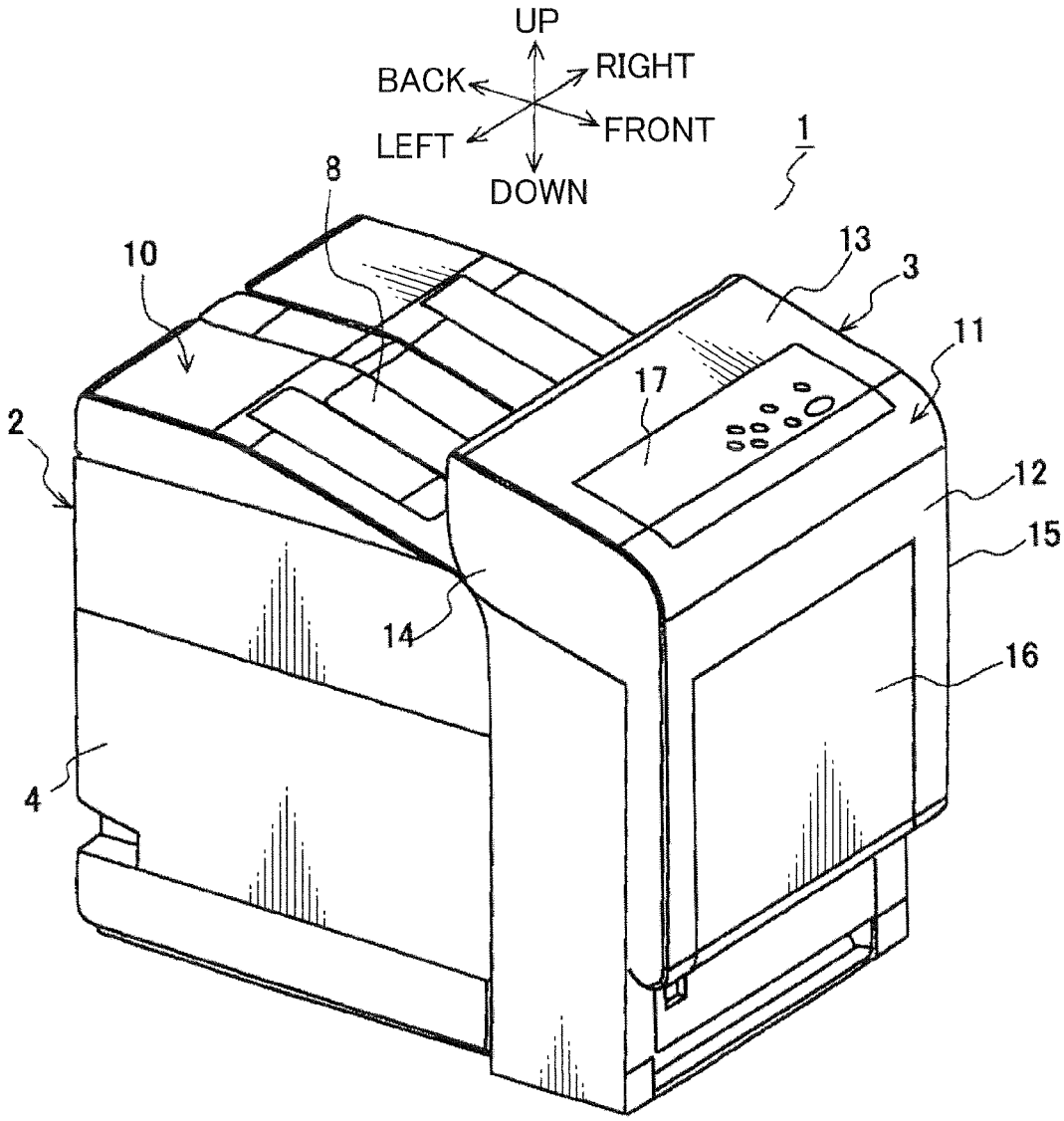
FIG. 1 is an overall perspective view of an image forming apparatus according to a first embodiment of the present invention, when it is viewed from a diagonally upward left front direction.

Hereinafter, embodiments of the present invention will be described in detail with reference to the drawings. Note that, in the respective drawings, members and the like denoted by same reference numerals respectively have same structures, and overlapping descriptions thereof will be appropriately omitted. Further, in the respective drawings, members and the like which are not required for explanation are appropriately omitted to be illustrated.

First Embodiment

Figure 2:
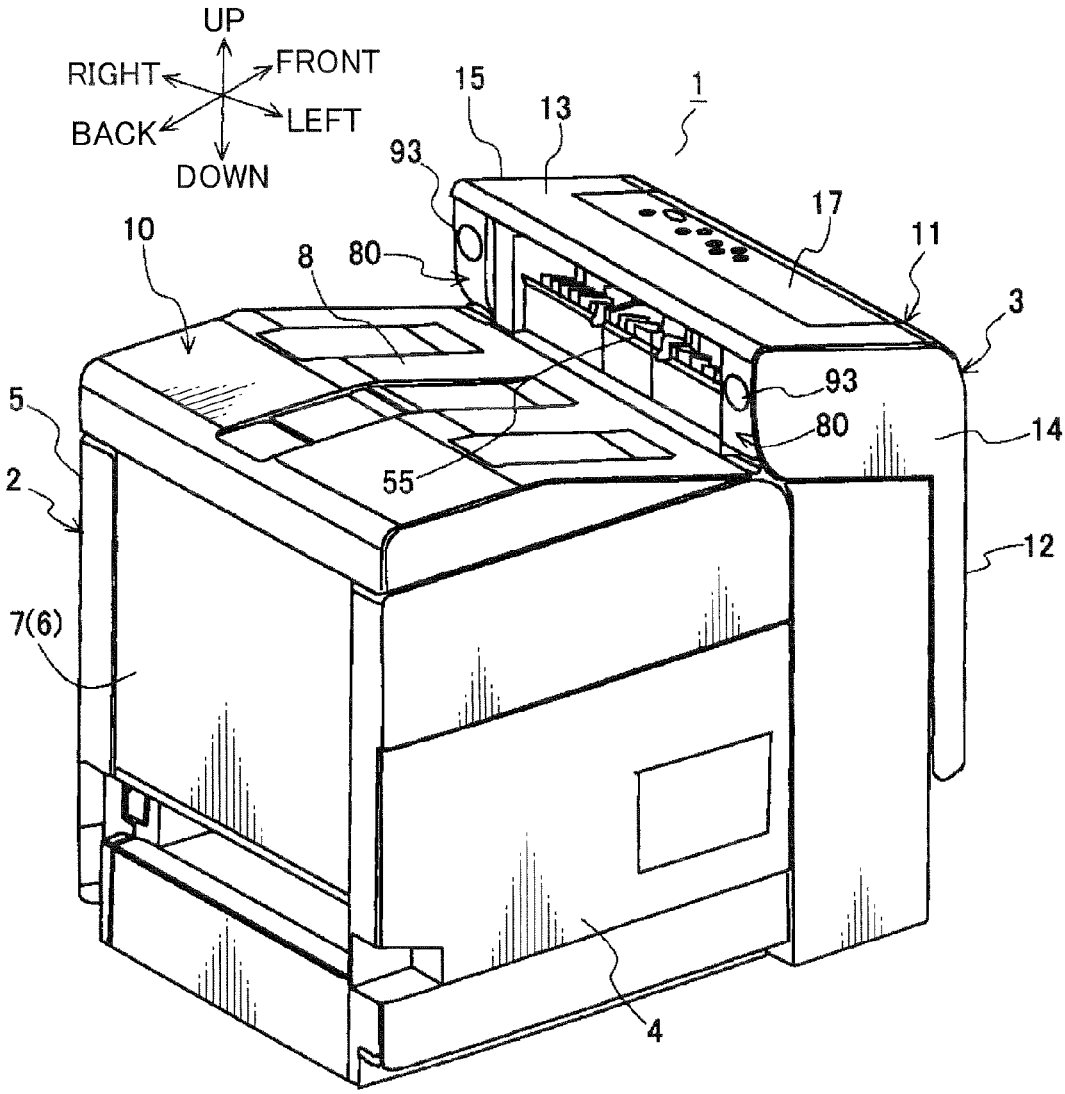
FIG. 2 is a perspective view of the image forming apparatus which is viewed from a diagonally upward left rear direction.
Figure 3:
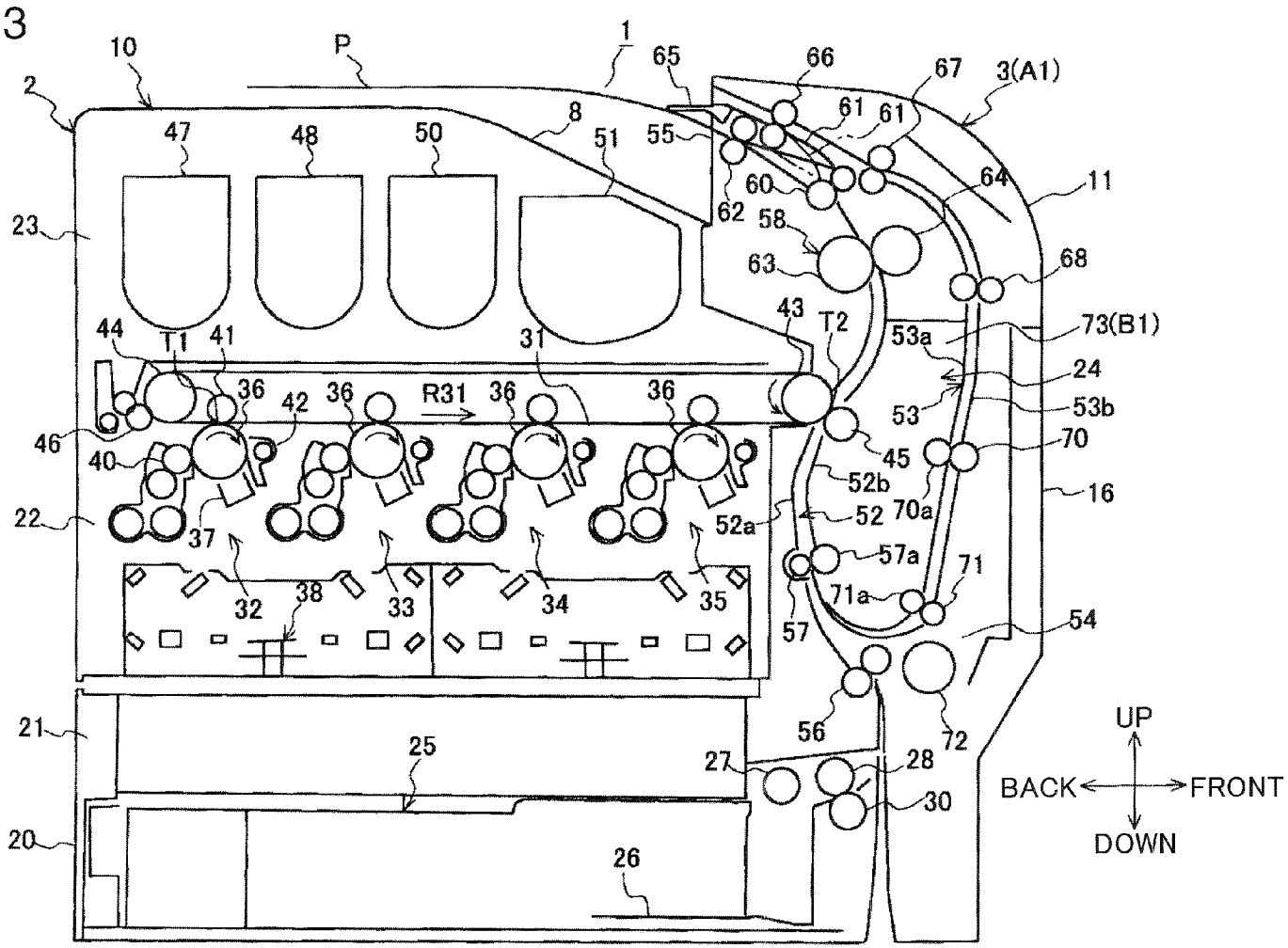
FIG. 3 is a sectional view schematically illustrating an internal structure of the image forming apparatus.
Figure 4:
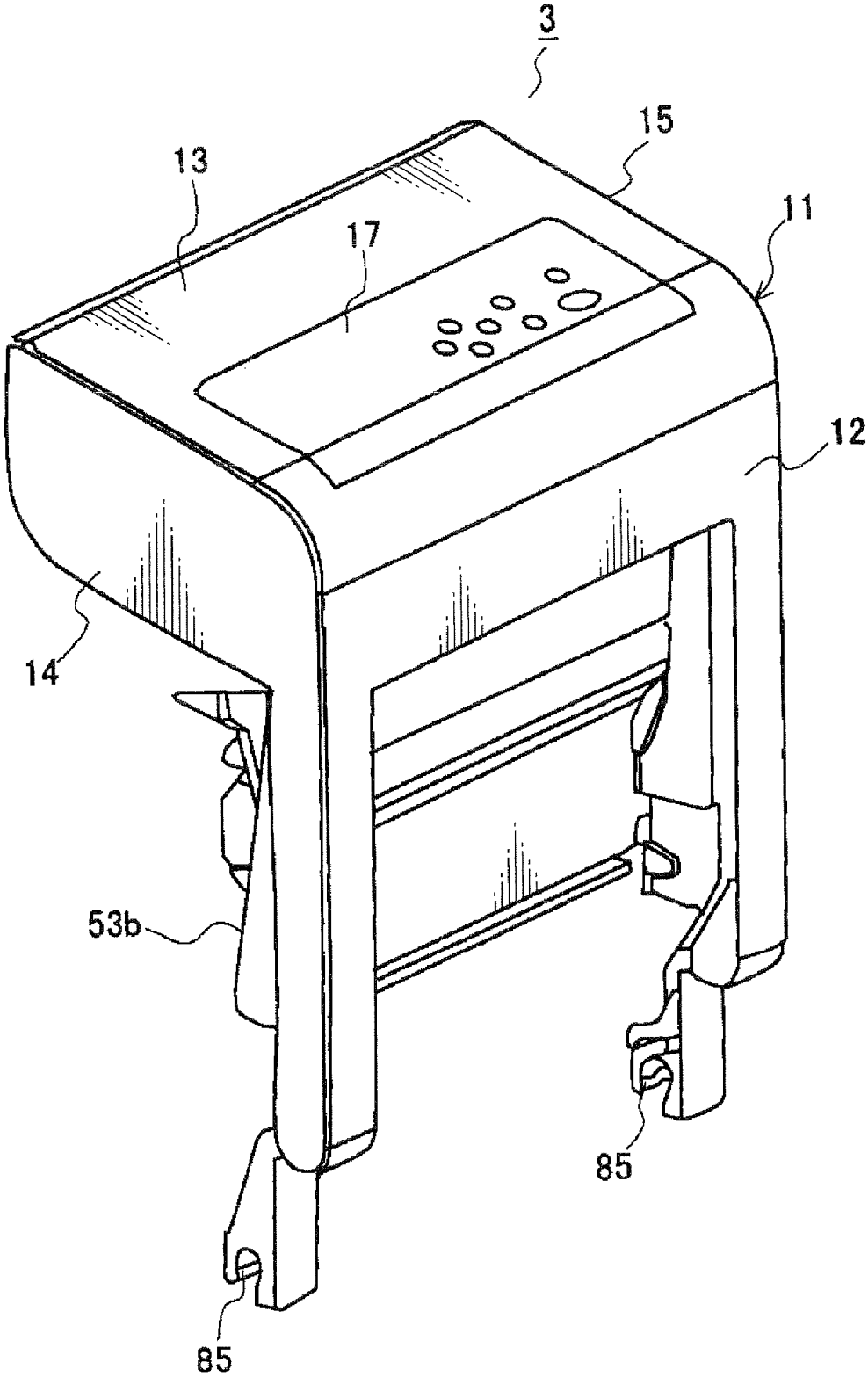
FIG. 4 is a perspective view of a front cover.

An entire structure of an image forming apparatus 1 according to a first embodiment will be described with reference to FIGS. 1 to 4. Note that, in FIGS. 1 to 3, up and down, front and back, and right and left directions with respect to the image forming apparatus 1 are indicated by arrows. In FIG. 4, a perspective view of a front cover 3 in a state of being detached from the sate of FIG. 1 is shown. However, a manual paper feed tray 16 which will be described later is detached in FIG. 4.

Here, as the image forming apparatus 1, a printer, a copier, a facsimile machine, and a multifunction machine thereof, or the like may be cited. However, in the following description, an example in a case in which the image forming apparatus 1 is a printer will be described. The image forming apparatus 1 is a full-color printer of four colors that employs an electrophotographic system, an intermediate transfer system, and a tandem system.

A structure in which the entire image forming apparatus 1 is viewed from the outside will be described with reference to FIGS. 1 and 2. The image forming apparatus 1 includes a substantially box-shaped (rectangular parallelpiped form) apparatus main body 2 of the image forming apparatus, and a front cover 3 supported in an openable/closable manner freely by the apparatus main body 2.

With respect to the apparatus main body 2, its anterior surface is covered with the front cover 3, and its left side and right side are covered with a left face panel 4 and a right face panel 5 which are made of synthetic resin. At a posterior surface of the apparatus main body 2, a part 7 of a sheet metal structuring a main body frame 6 is exposed as a structural object. At a superior surface of the apparatus main body 2, its anterior part is covered with the front cover 3, and a portion from an intermediate part to a posterior part is covered with a paper discharge tray 10 having a sheet loading surface 8 with a rising rear.

The front cover 3 includes a front face panel 11 located on an outer side, and a wall surface located at an inner side, which structures a part of a sheet conveying section 24 which will be described later. The front face panel 11 is composed of an anterior panel 12, an upper panel 13 with a rising rear which continues to the upper end the anterior panel 12, and inverted "L" left panel 14 and right panel 15, which are integrally structured.

The rectangular manual paper feed tray 16 is installed in the anterior panel 12. The manual paper feed tray 16 has a center of swinging at its lower end side, and at a closed position in a standing position illustrated in FIG. 1, the manual paper feed tray 16 structures a part of the anterior panel 12, and at an open position with a dropping rear in a state in which its upper end side is pulled out forward (not shown), the manual paper feed tray 16 serves as a paper feed stand on which sheets are placed on its superior surface.

An operation panel (operating unit) 17 to receive inputs of instructional information is disposed on the upper panel 13. The operation panel 17 is disposed so as to be turned substantially upward at a gentle slant with a slightly higher rear end side in order for an operator (for example, a user) standing in front of the image forming apparatus 1 to operate, to be easy to see it. A touch-panel type liquid crystal display unit and various buttons are disposed in the operation panel 17, and it is possible for the operator to carry out various information operations with respect to the image forming apparatus 1 through this operation panel 17 in a state of standing in front of the image forming apparatus 1. The left panel 14 and the right panel 15 are installed so as to respectively cover a part of the sheet conveying section 24 structured inside the front cover 3 from the left and the right.

The front cover 3 is, as will be described later, supported swingablly at its lower end side by the apparatus main body 2, and the entire front cover 3 is formed in a freely openable/closable manner such that its upper end side is opened so as to be separated away from the apparatus main body 2 at the open position. Release levers (release members) 80, which will be described later, to be operated at the time of opening the front cover 3, are installed at an inner side (right side) portion at the upper end side and the rear end side of the left panel 14 and at an inner side (left side) portion at the upper end side and the rear end side of the right panel 15 as illustrated in FIG. 2. Note that the release levers 80 will be described later in detail.

With respect to the front cover 3 having the above-described structure, it is possible for the operator to carry out a treatment for paper jam (a work for removing jammed sheets) after opening the front cover 3 toward the front side from the front surface side of the image forming apparatus 1. Moreover, as will be described later, it is possible to attache and detach a paper feed cassette 25 in which sheets to be objects on which images are formed are stacked, from the front surface side in the same way. In this way, it is possible for the operator to carry out all the entire operations of the image forming apparatus 1 by use of the operation panel 17, a treatment for the paper jam when paper jam is caused, supplement of sheets to the paper feed cassette 25 when sheets are run out, and the like, from the front surface side of the image forming apparatus 1.

Next, an internal structure of the image forming apparatus 1 will be described with reference to FIG. 3. In the image forming apparatus 1, a sheet housing unit 20, a substrate housing unit 21, an image forming unit 22, a toner supply unit 23, and the paper discharge tray 10 are provided in order from the lower side to the upper side of the apparatus main body 2. Further, the sheet conveying section 24 is provided between the anterior side of the apparatus main body 2 and the front cover 3.

The paper feed cassette 25 is installed in the sheet housing unit 20. The paper feed cassette 25 accommodates plural pieces of sheets in a stacked state, and the leading end side of the sheets in the stacked state (the right side in the drawing) are biased upward by a lift plate 26 installed at a bottom portion thereof. In accordance therewith, a sheet at the top in the paper feed cassette 25 is fed by a pickup roller 27 of the sheet conveying section 24 which will be described later, and further, lap-feeding is prevented by a feeding roller 28 and a retarding roller 30, and only one sheet is fed downstream. This paper feed cassette 25 is capable of being detached and attached from the front surface side of the image forming apparatus 1. The substrate housing unit 21 is installed above the paper feed cassette 25.

A substrate and electric components (not shown) to control the entire image forming apparatus 1 are installed in the substrate housing unit 21. The image forming unit 22 is installed above the substrate housing unit 21.

An intermediate transfer belt 31, and four (four-color) image forming stations having similar structures to each other, i.e., an yellow (Y) image forming station 32, a magenta (M) image forming station 33, a cyan (C) image forming station 34, and a black (B) image forming station 35 along a rotational direction of the intermediate transfer belt 31 (a direction of an arrow R 31) are installed in the image forming unit 22.

The yellow image forming station 32 has a photosensitive drum 36, and a charging device 37, an exposure device 38, a development device 40, a primary transfer roller 41, a drum cleaner 42, and the like which are installed along the rotational direction (the arrow direction) at the periphery of the photosensitive drum 36. The photosensitive drum 36 is driven to rotate at a predetermined processing speed in the arrow direction. After the outer peripheral surface of the photosensitive drum 36 is charged uniformly to have predetermined polarity and electric potential by the charging device 37, electric charges on an exposed portion are eliminated by exposure of the exposure device 38 according to image information transmitted from a personal computer (not shown) or the like, which forms an electrostatic latent image. This electrostatic latent image is developed as a toner image so as to adhere toner in a developer onto it by the development device 40.

The toner image formed on the surface of the photosensitive drum 36 is transferred onto the intermediate transfer belt 31. The intermediate transfer belt 31 is bridged between a driving roller 43 and a driven roller 44, and is rotated in the direction of the arrow R31 by rotation in the arrow direction of the driving roller 43. The yellow toner image formed on the photosensitive drum 36 is primarily transferred on the intermediate transfer belt 31 by the primary transfer roller 41 in a primary transfer section T1. After the primary transfer of the toner image, toner remaining on the surface of the photosensitive drum 36 (primary transfer residual toner) is removed by the drum cleaner 42.

The remaining three-color (cyan, magenta, black) image forming stations 33, 34, and 35 as well have structures similar to that of the above-described yellow image forming station 32. On the surfaces of the photosensitive drums 36 of these image forming stations 33, 34, and 35, toner images of the respective colors of cyan, magenta, and black are formed to be sequentially primarily transferred on the intermediate transfer belt 31 in the same way. In this way, the four-color toner images are superimposed on the intermediate transfer belt 31. The four-color toner images on the intermediate transfer belt 31 are collectively secondarily transferred onto a sheet conveyed by the sheet conveying section 24 which will be described later, by a secondary transfer roller 45 in a secondary transfer section T2. Toner remaining on the surface of the intermediate transfer belt 31 after the secondary transfer (secondary transfer residual toner) is removed by a belt cleaner 46 disposed in the vicinity of the driven roller 44. The toner supply unit 23 is provided above the image forming unit 22.

Four toner containers in which toners of the respective colors are respectively housed separately, i.e., yellow, magenta, cyan, and black toner containers 47, 48, 50, and 51 are installed in the toner supply unit 23. Density sensors (not shown) to sense a concentration of toner (a ratio by weight of toner/developer) are installed in the development devices 40 of the respective colors. When the concentration sensors sense that amounts of toners in the development devices 40 get less than predetermined values, toners are replenished to the development devices 40 of the respective colors from the respective color toner containers 47, 48, 50, and 51. The paper discharge tray 10 is provided above the toner supply unit 23.

The paper discharge tray 10 is formed so as to cover the superior surface of the apparatus main body 2. An intermediate part in an anteroposterior direction of the paper discharge tray 10 is at a slant so as to locate its rear end side above, and the rear end side of the paper discharge tray 10 is formed to be flat so as to continue to the intermediate part. Sheets discharged backward from a sheet discharge opening 55 of the sheet conveying section 24 which will be described next, are loaded on the sheet loading surface 8 on the superior surface of the paper discharge tray 10.

The sheet conveying section 24 is, in the present embodiment, provided between the anterior side of the apparatus main body 2 and the front cover 3. The sheet conveying section 24 has a sheet conveying path 52 (a first sheet conveying path) to guide a sheet from a lower side toward an upper side, a sheet reconveying path 53 (a second sheet conveying path), which is installed at a side anterior to the sheet conveying path 52, to guide a sheet from an upper side toward a lower side, and a manual feeding section 54. Note that, in the present embodiment, the sheet reconveying path 53 is a sheet conveying path directly opened by opening the front cover 3, which will be described later. Further, the sheet conveying path 52 is a sheet conveying path indirectly opened via a conveying unit 73, which will be described later, by opening the front cover 3.

The sheet conveying path 52 orients upwardly from the vicinity of the above-described feeding roller 28, and extends upward so as to gently curve backward in a convex manner, and extends upward so as to turn a curving direction forward in the vicinity of the intermediate transfer belt 31, and extends diagonally upward and backward, to reach the sheet discharge opening 55. The sheet conveying path 52 is composed of a rear side guide 52*a* and a front side guide 52*b* facing each other, and a part of the front side guide 52*b* is formed in the conveying unit 73 which will be described later.

At the sheet conveying path 52, the pickup roller 27, the feeding roller 28, the retarding roller 30, a pair of conveying path rollers 56, a pair of registration rollers 57, the secondary transfer roller 45 interposing the above-described intermediate transfer belt 31 between it and the driving roller 43, a pair of fixing rollers 58, a pair of conveying rollers 60, a switching flapper 61, a pair of paper discharge rollers 62, and the like are installed in order from the lower side. The pair of fixing rollers 58 includes a fixing roller 63 having a heater (not shown) built-in and a pressure roller 64 brought into contact with the fixing roller 63 to structure a fixing nip portion therebetween.

Only one sheet fed from the paper feed cassette 25 by the pickup roller 27, the feeding roller 28, and the retarding roller 30 is conveyed by the pair of conveying rollers 56 and the pair of registration rollers 57. The four-color toner images on the intermediate transfer belt 31 are collectively secondarily transferred on this paper in the secondary transfer section T2, and when this sheet pass through the fixing nip portion, the sheet is heated and pressed to fix the toner image on its surface. The sheet on which the toner image has been fixed is guided to the lower surface of the switching flapper 61 by the pair of conveying rollers 60 to be conveyed to the pair of paper discharge rollers 62. The sheet is discharged backward from the sheet discharge opening 55 facing the back surface side by the pair of paper discharge rollers 62, to be loaded on the sheet loading surface 8 of the paper discharge tray 10. Note that, in FIG. 3, a state in which a sensor flag 65 of a paper discharging sensor disposed directly downstream of the pair of paper discharge rollers 62 is operated by a sheet P in the process of being discharged.

The sheet reconveying path 53 extends at a slant toward the anterior side from slightly above the sheet discharge opening 55, and extends at a steep slant backward so as to gently curve, and joins together with the sheet conveying path 52 so as to curve downward in a convex manner at the lower end portion. The sheet reconveying path 53 is composed a rear side guide 53*a* and a front side guide (guiding portion) 53*b* facing each other. A part of the rear side guide 53*a* is formed in the conveying unit 73 which will be described later. Further, most of the front side guide 53*b* is built into the inner side (rear end side) of the face panel 11, and structures the front cover 3 along with the face panel 11. At the sheet reconveying path 53, a pair of reverse rollers 66, a switching flapper 61, first, second, third, and fourth pairs of reconveying rollers 67, 68, 70, and 71 are installed in order from the upper side which is the upper stream side at the time of reconveying a sheet.

When an image is formed on both surfaces of a sheet, the switching flapper 61 is switched to a position shown by the chain double-dashed line. The sheet on which the toner image is fixed on its surface is conveyed to the pair of conveying rollers 60 to be conveyed along the superior surface of the switching flapper 61, and is further conveyed backward by the pair of reverse rollers 66. Before the trailing end of the sheet passes through the pair of reverse rollers 66 after passing through the pair of conveying rollers 60, the pair of reverse rollers 66 is reversely rotated. In accordance therewith, the sheet is conveyed downward by the first to fourth pairs of reconveying rollers 67, 68, 70, and 71 to be conveyed to the sheet conveying path 52. Then, the toner image is transferred and fixed on the reverse surface of the sheet in the same way as the surface, and the sheet is discharged backward from the sheet discharge opening 55 to be loaded on the sheet loading surface 8 of the paper discharge tray 10. Note that a manual feeding roller 72 is installed directly in front of the pair of conveying rollers 56 in the sheet conveying section 24, and the manual paper feed tray 16 structuring a part of the front cover 3 is pulled out in a closed state, and it is possible to feed sheets set on the manual paper feed tray 16 toward the side of the pair of conveying rollers 56.

As described above, the sheet conveying section 24 is composed of the conveying unit 73 capable of opening and closing partially. The conveying unit 73 is disposed between the sheet conveying path 52 and the sheet reconveying path 53. The conveying unit 73 includes a part of the front side guide 52*a* of the sheet conveying path 52 and a part of the rear side guide 53*a* of the sheet reconveying path 53, one roller 57*a* of the pair of registration rollers 57, the secondary transfer roller 45, and respective one side rollers 70*a* and 71*a* of the third and fourth pairs of reconveying rollers 70 and 71, which are integrally structured.

The conveying unit 73 is supported swingablly at its lower end side by the apparatus main body. The conveying unit 73 is interposed between the front cover 3 disposed at the closed position and the anterior surface side of the apparatus main body 2, and is supported in a freely openable/closable manner by the apparatus main body 2 so as to be capable of changing in position between a closed position to structure a part of the sheet conveying path 52 and a part of the sheet reconveying path 53, and an open position to open a part of the sheet conveying path 52 and the sheet reconveying path 53 according to opening of the front cover 3.

Figure 5:
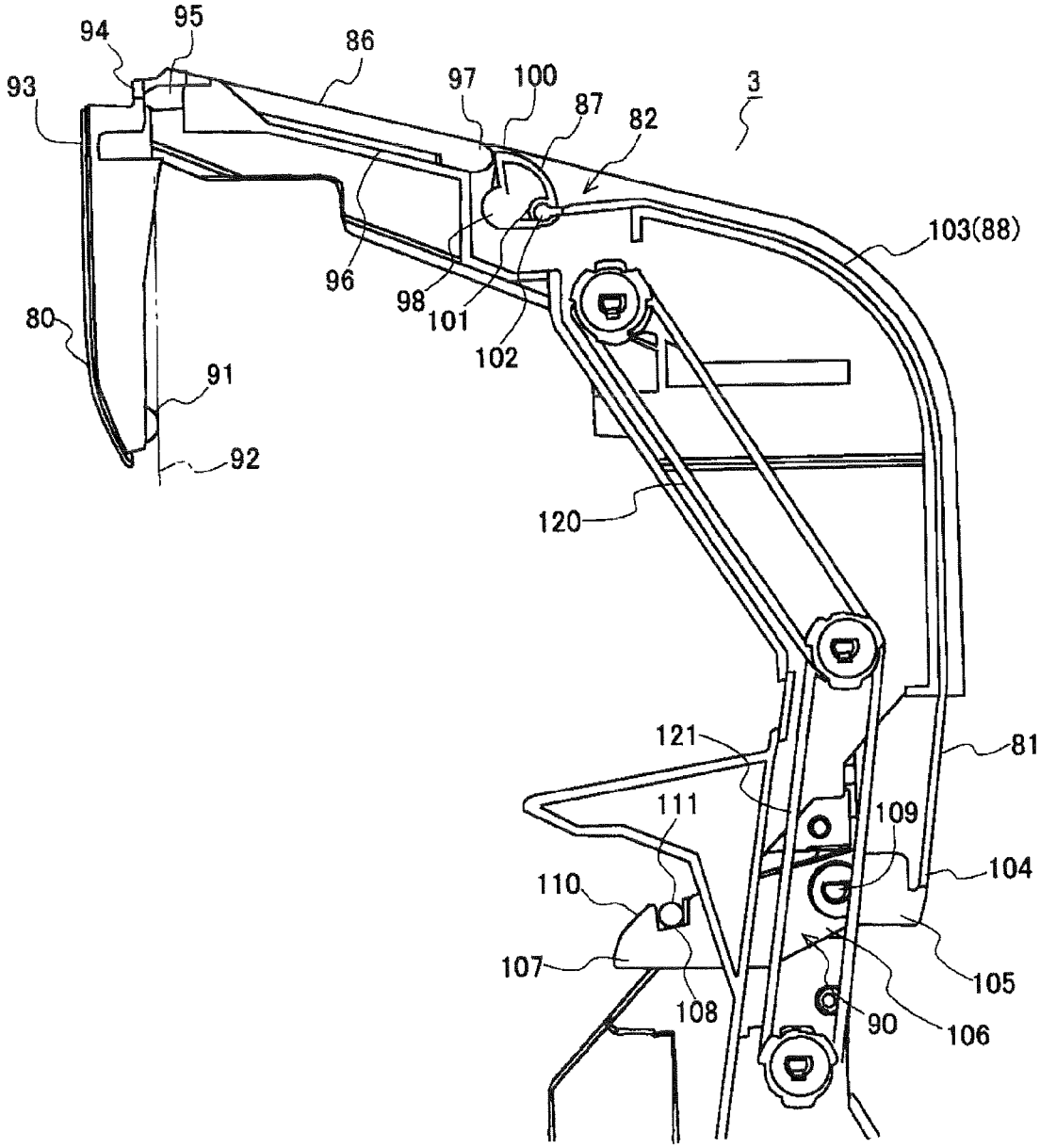
FIG. 5 is a view of an upper side portion of the front cover in a state in which a left panel is detached, when it is viewed from the left side.
Figure 6:
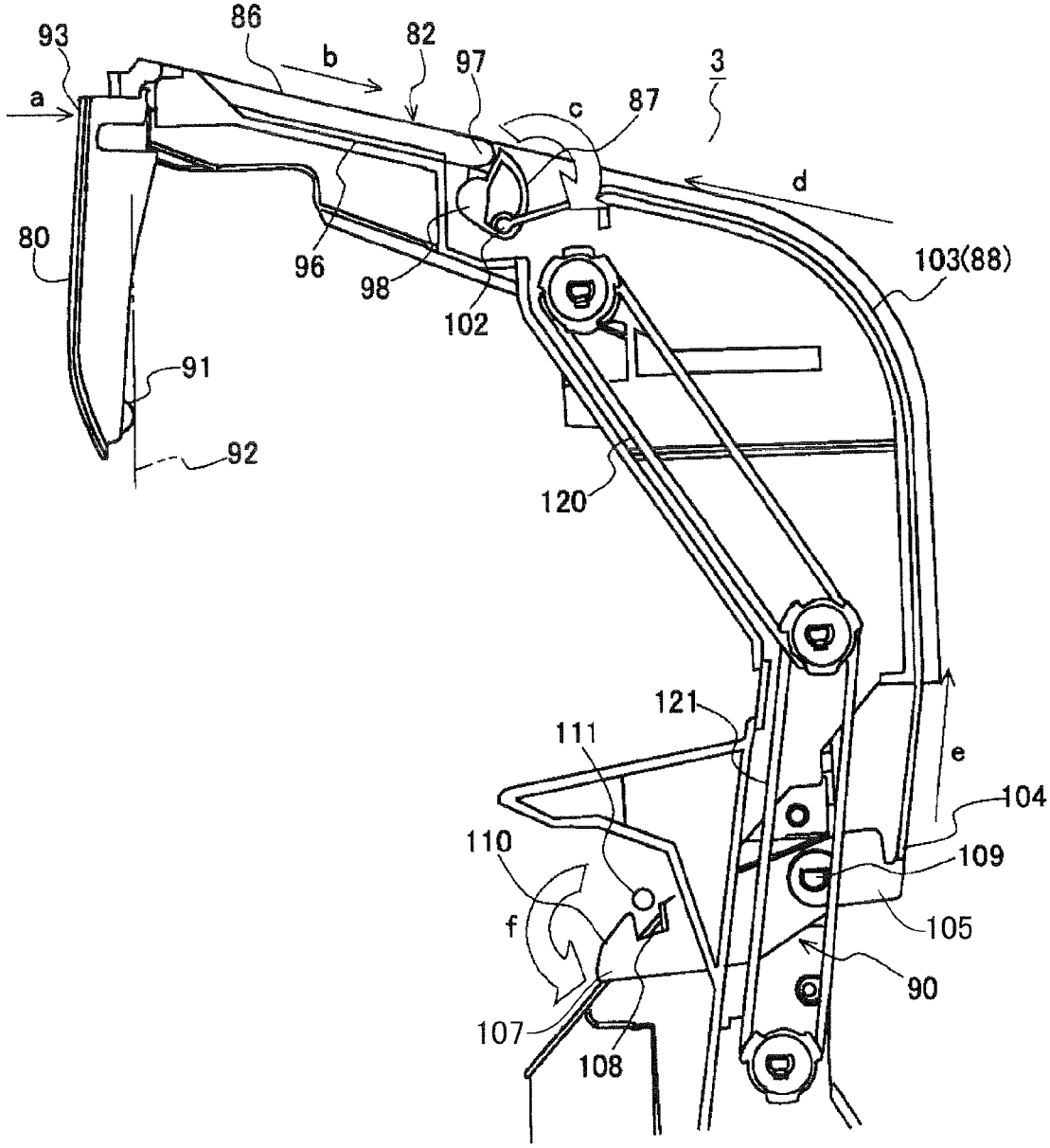
FIG. 6 is a view for explanation of a state in which a lock member is operated by operating a release lever serving as a release member from the state illustrated in FIG. 5.
Figure 7:
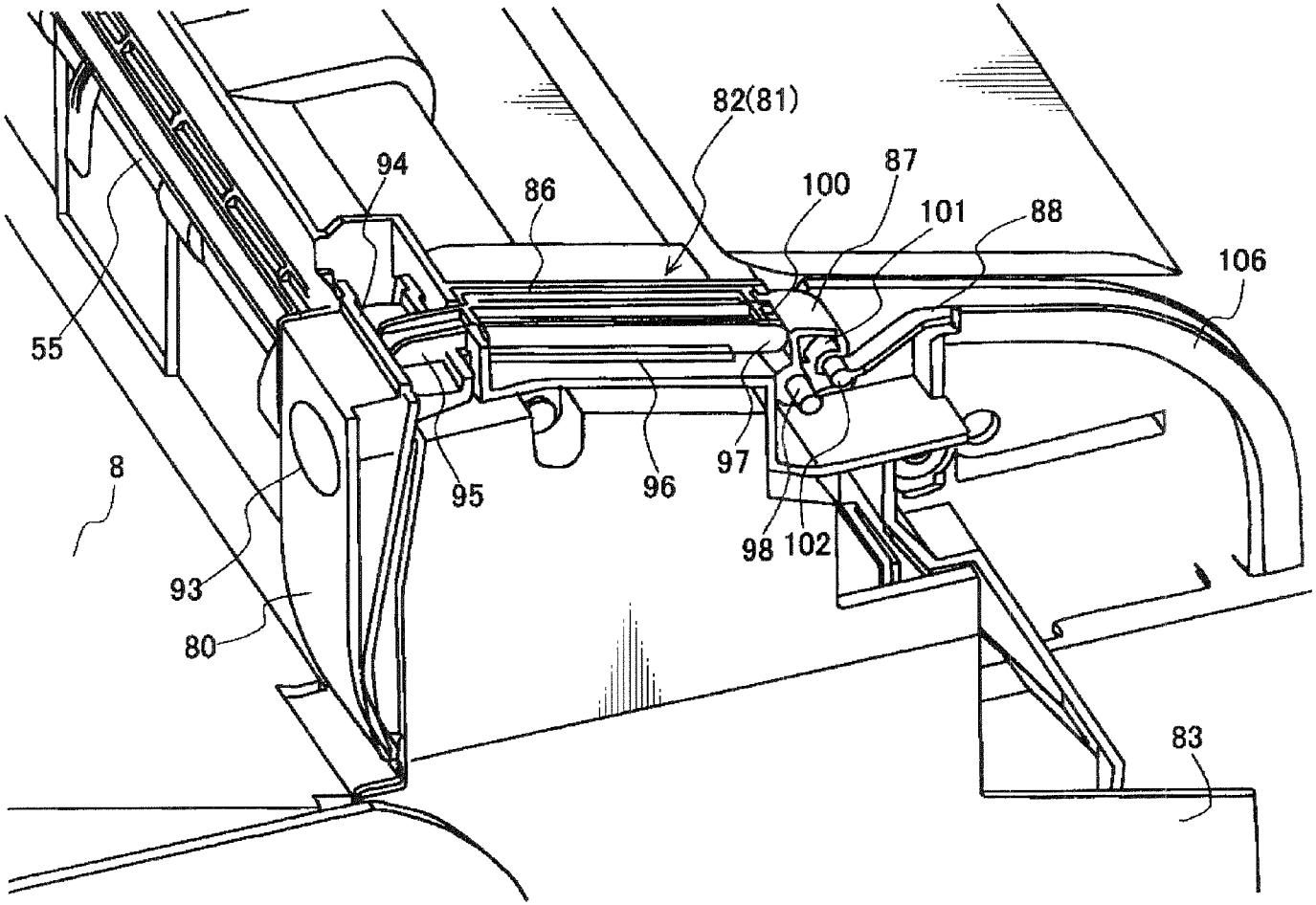
FIG. 7 is an enlarged perspective view for explanation of structure members of the lock member according to the first embodiment.
Figure 8:
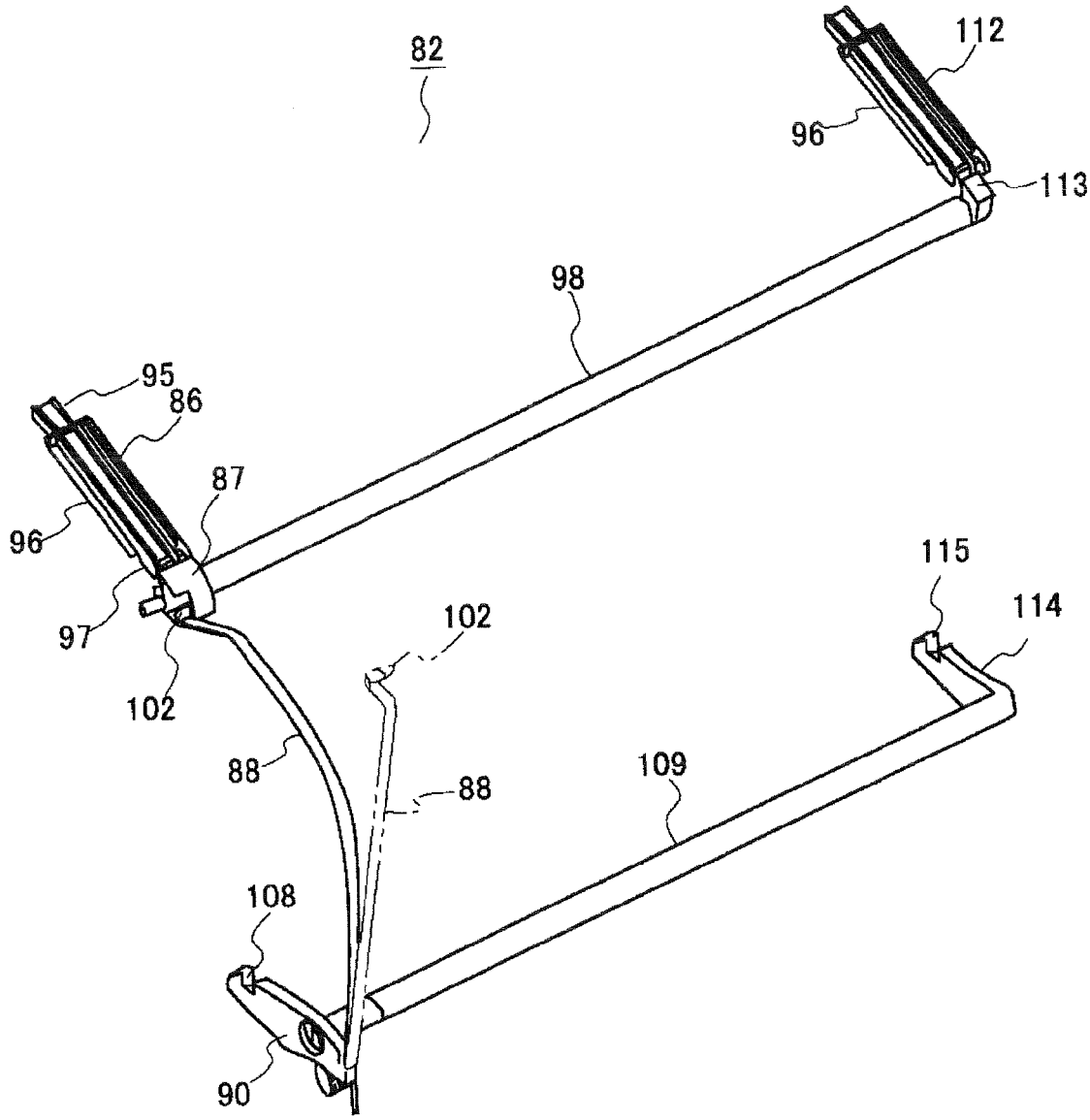
FIG. 8 is a perspective view illustrating the structure members of the lock member which are taken out.
Figure 9A:
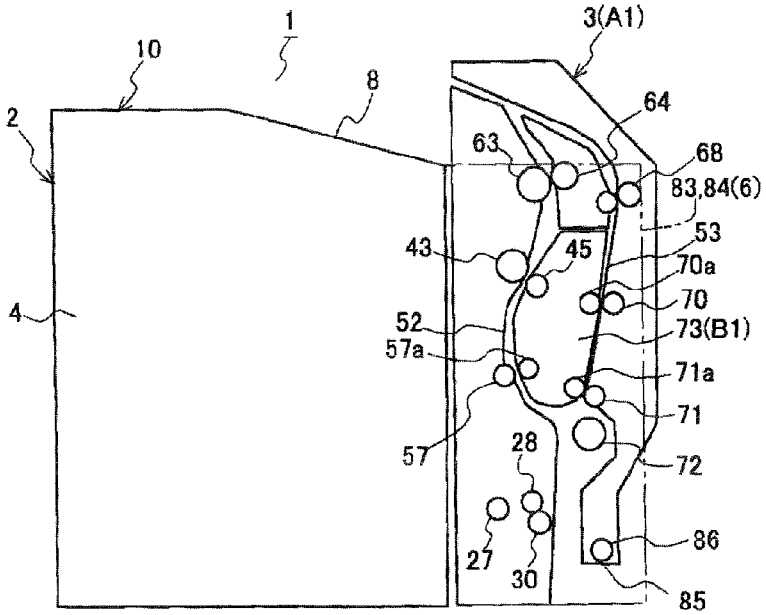
FIGS. 9A and 9B are schematic diagrams for explanation of the front cover and a conveying unit.
Figure 9B:
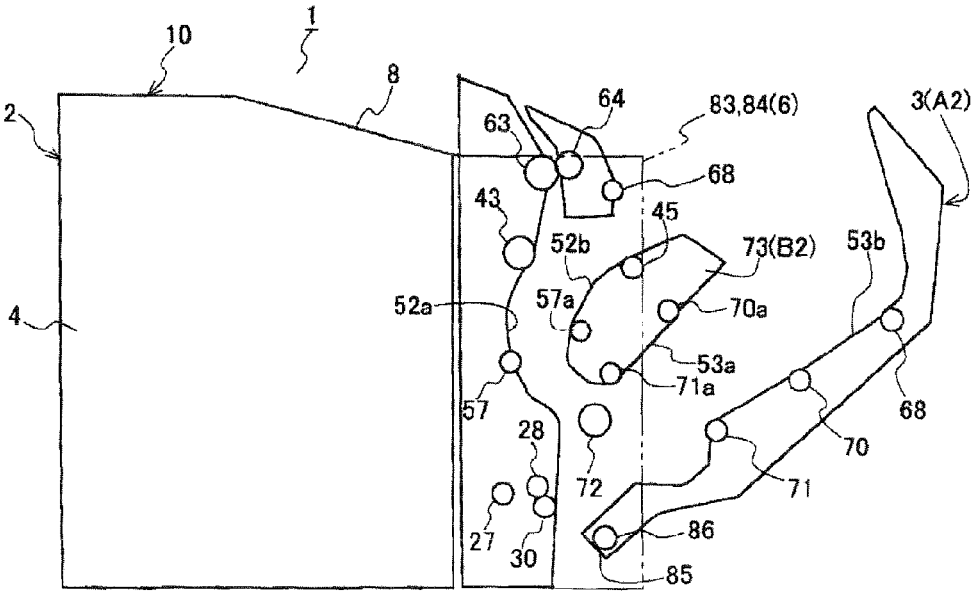

Next, the front cover 3 will be described in detail with reference to FIGS. 4 to 9. FIG. 4 is a perspective view of the front cover 3 in a state of being detached from the image forming apparatus 1 illustrated in FIG. 1. However, in FIG. 4, a state in which the manual paper feed tray 16 is detached is illustrated. FIG. 5 is a view of an upper side portion of the front cover 3 in a state in which the left panel 14 (refer to FIG. 1) is detached, which is viewed from the left side. FIG. 6 is a view illustrating a state in which the release lever 80 is operated from a state illustrated in FIG. 5. FIG. 7 is a perspective view illustrating the release lever 80 and a lock member 81 (lock member assembly). A retention mechanism 82 is composed of the release lever 80 and the lock member 81. FIG. 8 is a perspective view illustrating the lock member 81 which is taken out. Further, FIGS. 9A and 9B are schematic views for explanation of the front cover 3 and the conveying unit 73, and FIG. 9A is a view illustrating closed positions A1 and B1 of the front cover 3 and the conveying unit 73, and FIG. 9B is a view illustrating open positions A2 and B2 thereof. Note that, in FIGS. 9A and 9B, a left side plate 83 and a right side plate 84 structuring a part of the main body frame 6 of the apparatus main body 2 are illustrated by the chain double-dashed lines. The left side plate 83 is disposed so as to cover the left side surface of the conveying unit 73 and the front cover 3, and the right side plate 84 is disposed so as to cover the right side surface of the conveying unit 73 and the front cover 3.

As illustrated in FIG. 4, the front cover 3 has a pivot point 85 at the lower end, and the pivot point 85 is supported pivotally by the apparatus main body 2. With respect to the apparatus main body 2, as illustrated in FIGS. 9A and 9B, portions extending forward of the left side plate 83 and the right side plate 84 of the main body frame 6 made of plate cover the parts of the left side surface and the right side surface of the front cover 3 and the left side surface and the right side surface of the conveying unit 73.

A shaft 86 is provided to project at the lower ends of the anterior end sides of the left side plate 83 and the right side plate 84. The pivot point 85 of the front cover 3 is supported pivotally by the shaft 86. Hereby, the front cover 3 is capable of changing in position between the closed position A1 illustrated in FIG. 9A and the open position A2 illustrated in FIG. 9B. The above-described conveying unit 73 as well has a pivot point (not shown) at the lower end side, and is supported pivotally by a shaft (not shown) provided to project from the left side plate 83 and the right side plate 84 at the side of the apparatus main body 2. Hereby, the conveying unit 73 is capable of changing in position between the closed position B1 illustrated in FIG. 9A and the open position B2 illustrated in FIG. 9B.

In the present embodiment, with respect to the conveying unit 73, there is no need for the operator to carry out opening and closing operations positively in particular, and when the front cover 3 is opened, the conveying unit 73 is opened according to that, and when front cover 3 is closed, the front cover 3 is closed according to that. Note that the front cover 3 and the conveying unit 73 stop in a state of retaining appropriate slope positions, as illustrated in FIG. 9B, by stoppers, springs, and the like provided at the side of the apparatus main body 2.

When the front cover 3 is opened, the operator operates the release lever 80 of the retention mechanism 82. As illustrated in FIGS. 5 to 8, the retention mechanism 82 includes the release lever 80 (release member) and the lock member 81 operated by the release lever 80. The lock member (lock member assembly) has a slide member 86, a rotary member 87, a connecting member 88, and a hook 90.

The release lever 80 is formed to be vertically long, and a circular arc shaped fulcrum 91 is provided to project at the lower end side. The fulcrum 91 is brought into contact with a contact portion 92 (illustrated by the dashed-two doted line) serving as a part of the front cover 3. The release lever 80 is capable of moving its upper end side in a substantially antero-posterior direction centering on the fulcrum 91. On the back surface sides at the upper end sides of the release levers 80, as illustrated in FIG. 2, in order for an operator to easily get his or her fingers caught in, circular buttons 93 are formed. The buttons 93 face the back surface side, which cannot be viewed from the operator operating the operation panel 17 at the front surface side (the opening and closing direction of the front cover 3) of the image forming apparatus 1.

A measure from the fulcrum 91 up to the center of the button 93 is set such that, when an ordinary adult gently puts together four fingers other than his or her first finger, and puts his or her index finger onto the center of the button 93, his or her little finger at the lower side touches a portion above the fulcrum 91. Moreover, the vicinity of a portion corresponding to the fulcrum 91 at the back surface side of the release lever 80 gently curves backward in a convex manner. Thereby, except for a case in which the operator operates an extremely lower end side of the release lever 80, even when any position thereof is operated, the upper end side having the button 93 moves forward.

A pressing portion 94 is provided to project at the anterior surface side at the upper end side of the release lever 80, and the pressing portion 94 is brought into contact with a base end portion 95 of the slide member 86. In the present embodiment, the release levers 80 are disposed so as to face the back surface side at positions posterior to the operation panel 17, and at the inner side (right side) at the upper end side and the rear end side of the left panel 14 (refer to FIG. 2), and at the inner side (left side) at the upper end side and the rear end side of the right panel 15. The positions correspond to the left side and the right side of the peripheral portion of the sheet discharge opening 55. To further describe, because the sheet discharge opening 55 is structured to face the back surface side so as to project upward from the paper discharge tray 10 on the superior surface of the apparatus main body 2 at the anterior part at the superior surface of the apparatus main body 2, it is possible for the operator located at the front surface side of the image forming apparatus 1 to easily operate it at the time of operating the release levers 80 positively with apparent intention to operate it.

The slide member 86 is formed into a rod-like shape anteroposteriorly long, and as illustrated in FIG. 7, the slide member 86 is installed so as to be anteroposteriorly slidable by being interposed between a left slide guide 96 and a right slide guide (not shown) which are anteroposteriorly provided to project upward. The slide member 86 is restricted on its vertical positions so as to be not lifted by the upper panel 13 (refer to FIGS. 1 and 2). The slide member 86 is brought into contact with the pressing portion 94 of the release lever 80 at its base end portion (first end portion) 95, and brought into contact with the rotary member 87 which will be described next at its leading end portion (second end portion) 97.

The rotary member 87, as illustrated in FIGS. 5 to 7, its shape viewed from the left is formed into a substantially fan shape, and is made rotatable centering on the shaft 98 integrally structured therewith. The rotary member 87 has a contacting portion 100 at the rear end side, and a leading end portion 97 of the slide member 86 is brought into contact with the contacting portion 100. Further, the rotary member 87 has a catching portion 101 at the anterior end side, and a base end portion 102 of the connecting member 88 which will be described next is brought to make an engagement with the catching portion 101. The rotary member 87 is configured to pull the base end portion 102 (first connecting portion) of the connecting member 88 diagonally downward left when being rotated in a clockwise direction in FIG. 5 centering on the shaft 98.

The connecting member 88 is formed into a belt shape with flexibility, and the base end portion 102 is brought to make an engagement with the rotary member 87, and an intermediate part 103 extends forward and gently curves along the front cover 3, and further extends downward to make the leading end portion 104 (second connecting portion) connect to the base end portion 105 of the hook 90. Note that, in FIG. 8, the connecting member 88 in a state in which the engagement with the rotary member 87 is released is illustrated by the chain double-dashed line. The connecting member 88 is guided by being fitted into a groove 106 (refer to FIG. 7) formed in the front cover 3.

The base end portion 105 of the hook 90 is connected to the leading end portion 104 of the connecting member 88, and the intermediate part 106 thereof is supported pivotally by a shaft 109 at the side of the front cover 3. The upward catching concave portion 108 is formed in the leading end portion 107 of the hook 90, and an inclined portion 110 is formed at a further leading end side of the catching concave portion 108. A catching convex portion 111 (a predetermined engaging member) with which the catching concave portion 108 of the hook 90 is brought to make an engagement and detached is provided to project on the left side plate 83 of the apparatus main body 2 illustrated in FIGS. 9A and 9B. Note that the hook 90 is biased in a clockwise direction in FIG. 5 by a biasing member (for example, a torsion spring), and the hook 90 brought to make an engagement with the catching convex portion 111 is biased by the biasing member so as to retain the engaged state with the catching convex portion 111.

Note that a stopper (not shown) to restrict a pivoting range (moving range) of the hook 90 is provided to the front cover 3, and a position of the hook 90 at the time of releasing the engagement, i.e., at the time of opening the front cover 3 is restricted thereby. The stopper is set to be located such that, when the front cover 3 in an open state is gradually closed, the inclined portion 110 of the hook 90 touches the catching convex portion 111 to once retreat, and the catching concave portion 108 is brought to make an engagement with the catching convex portion 111. Note that, in FIGS. 5 and 6, timing belts 120 and 121 to drive the first, second, and third pairs of reconveying rollers 67, 68, and 70 (refer to FIG. 3) are illustrated.

The release levers 80 are installed at the both of the left end side and the right end side of the front cover 3. Hereby, as illustrated in FIG. 8, a right slide member 112 and a part 113 of the rotary member are installed at a position corresponding to the right release lever 80, and the part 113 is integrally structured with the rotary member 87 via the shaft 98. Moreover, a hook 114 having a catching concave portion 115 is installed at the right side, and is fixed to the shaft 109 integrated with the left hook 90. Note that a catching convex portion (not shown) which is similar to the catching convex portion 111 of the left side plate 83 is installed at a position corresponding to the catching concave portion 115 of the right hook 114. In the present embodiment, because the lock member 81 is structured as described above, provided that at least one of the left and right release levers 80 is operated, it is possible to release locking of the hooks 90 and 114 with respect to the catching convex portion 111 and the like to open the front cover 3.

Here, the respective members structuring the above-described retention mechanism 82, i.e., the release lever 80, the slide member 86, the rotary member 87, the connecting member 88, and the hook 90 may be formed of, for example, synthetic resin. Moreover, in the present embodiment, because the connecting member 88 and the hook 90 are formed integrally, it is possible to decrease a number of components of structural members of the retention mechanism 82 by that much.

For example, when paper jam is caused in the sheet conveying section 24, the front cover 3 can be opened as follows. When the operator presses the button 93 of the release lever 80 at least one of the left and right release levers 80 illustrated in FIG. 2 toward the front side (anterior surface side: in a direction of an arrow a) as illustrated in FIG. 6, the pressing portion 94 of the release lever 80 presses and moves the slide member 86 toward the front side (in a direction of an arrow b). Hereby, the leading end portion 97 of the slide member 86 makes the rotary member 87 rotate in a direction of an arrow c. Then, because the base end portion 102 of the connecting member 88 is pulled in a direction of an arrow d, the leading end portion 104 of the connecting member 88 is pulled up in a direction of an arrow e to lift up the base end portion 105 of the hook 90, which makes the leading end portion 107 of the hook 90 rotate in a direction of an arrow f.

Thereby, the engagement of the catching concave portion 108 of the hook 90 with respect to the catching convex portion 111 at the side of the apparatus main body 2 is released. Moreover, it is possible for the operator facing the front cover 3 to open the front cover 3 to change its position to the open position A2 illustrated in FIG. 9B by pulling the vicinity of the release lever 80 of the front cover 3 to the front side. According to this, the conveying unit 73 as well is opened to change its position to the open position B2.

Accordingly, because the sheet reconveying path 53 between the front cover 3 and the conveying unit 73, and the sheet conveying path 52 between the apparatus main body 2 and the conveying unit 73 are opened, it is possible for the operator to easily remove the jammed sheet. After the treatment for paper jam, when the operator closes the front cover 3 to return it to the closed position A1 while pushing the conveying unit 73 with the front cover 3, the hook 90 of the retention mechanism 82 is brought to make an engagement with the catching convex portion 111 at the side of the apparatus main body 2, which retains a closed state.

In the present embodiment, because the release levers 80 are installed on the plane (portion) located posterior to the operation panel 17 at the upper end side of the front cover 3, and on the plane (portion) facing the back surface side, it is difficult to view the release levers 80 from the front surface side of the image forming apparatus 1, where the operator is located at the time of operating the operation panel 17, which makes it hard to carry out an incorrect operation. Additionally, when the operator makes an attempt to operate the release lever 80 positively with the intention of operating it, it is possible for the operator to easily operate it without moving from the front surface side in particular.

Further, because both of the anterior panel 12 and the upper panel 13 of the front cover 3 are formed to be relatively flat, and there are no portions to be grasped particularly at the time of opening the front cover 3, the operator naturally puts his or her hands on the rear ends of the left panel 14 and the right panel 15 projected upward from the paper discharge tray. Then, when the operator puts his or her right and left first fingers on the left end and the right end at the rear end of the upper panel 17, the other four fingers are put on the release levers 80, and in particular, the index fingers are to be hooked on the buttons 93 of the release levers 80. Then, provided that the buttons 93 are pressed toward the front side, and directly, the left and right hands are withdrawn to the front side, it is possible to open the front cover 3. Namely, because a direction of operating the release levers 80 by the operator and a direction of opening the front cover 3 are substantially the same, it is possible for the operator to smoothly carry out an operation of the release levers 80 to an operation of opening the front cover 3 as a series of operations along a same direction.

The release levers 80 are installed on the datum plane along a substantially vertical direction with respect to a plane (datum plane) perpendicular to the anteroposterior direction. Namely, the buttons 93 of the release levers 80 are directed to the back surface side (substantially right behind). Therefore, the release levers 80 can be hardly viewed with eyes from the front surface side of the image forming apparatus 1, which does not spoil the beauty thereof.

In the present embodiment, the effect that the release levers 80 are directed to the back surface side is not limited to be right behind. Namely, there are cases to be included in which the release levers 80 are disposed on a virtual plane surface disposed at an appropriate angle with respect to the datum plane. For example, even in cases in which a virtual plane surface is at an inclined angle of 15 degrees, 30 degrees, 45 degrees, 60 degrees, or the like with respect to the datum plane, the release levers 80 is made hard to be viewed from the front surface side. In an extreme case, if an inclined angle is less than 90 degrees, in other words, in a case of a virtual plane surface in which a normal line set up on the virtual plane surface has a backward component, the release levers 80 are made to hard to be viewed at least from the front surface side.

Second Embodiment

In the first embodiment, the explanation has been made with a focus on the places at which the release levers 80 are disposed. In this second embodiment, an embodiment with a focus on a structure for positioning the front cover 3 and the conveying unit 73 in the closed states will be described.

Figure 10:
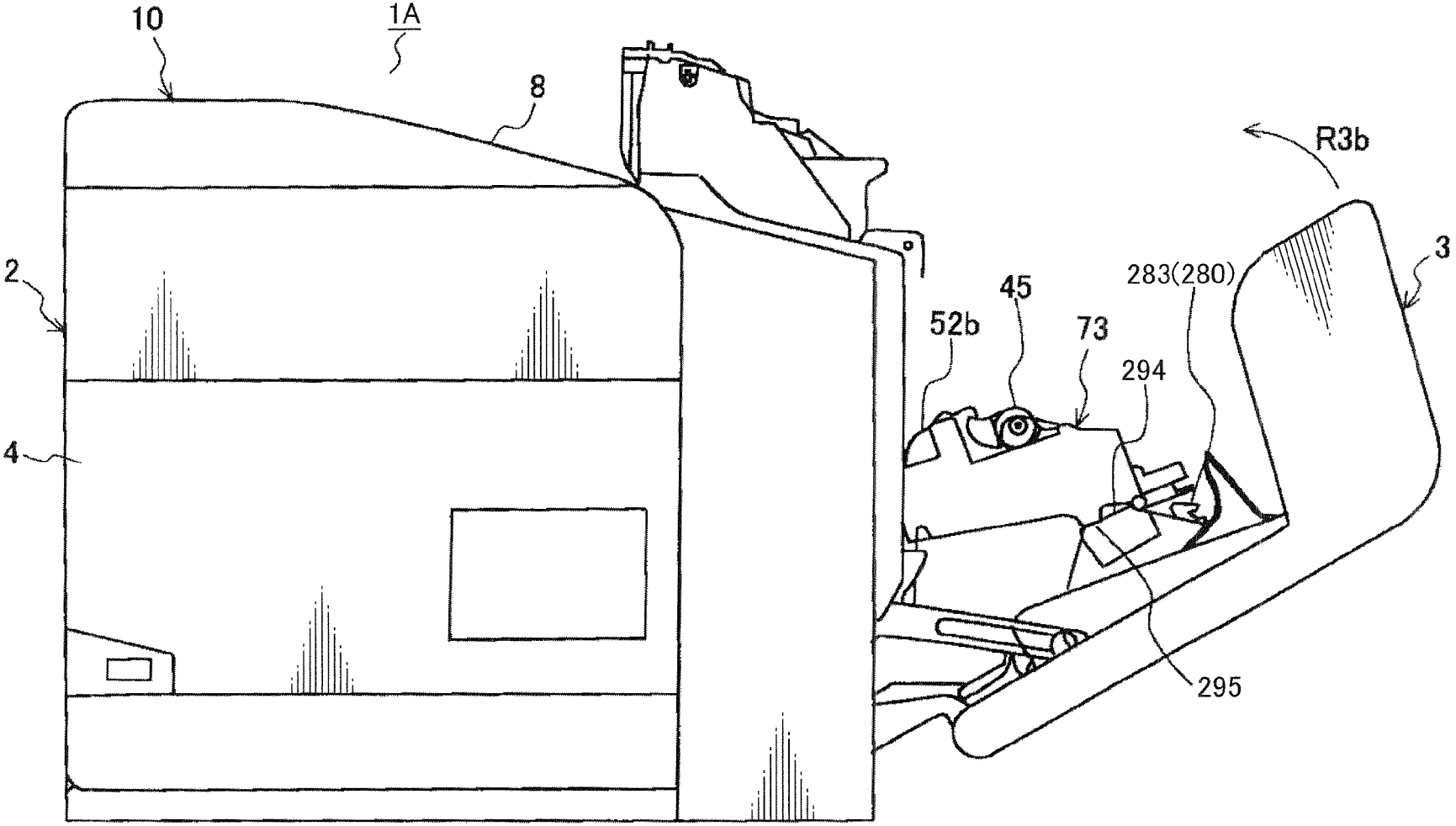
FIG. 10 is a side view illustrating an image forming apparatus according to a second embodiment of the present invention.

FIG. 10 is a side view illustrating an image forming apparatus 1A according to the second embodiment of the present invention, and a view illustrating a position at which a lock mechanism 280 (corresponding to the lock member assembly) according to the present embodiment is disposed. The lock mechanism 280 (a hook member 283) is a member corresponding to the lock member 81 (the hook 90) in the first embodiment, and is to position and fix the front cover 3 and the conveying unit 73 to the apparatus main body 2. In FIG. 10 and FIGS. 11 to 14, portions denoted by the same reference numerals of FIGS. 1 to 9 used for the explanation of the first embodiment denote the same portions, and descriptions thereof are omitted or simplified.

Figure 11:
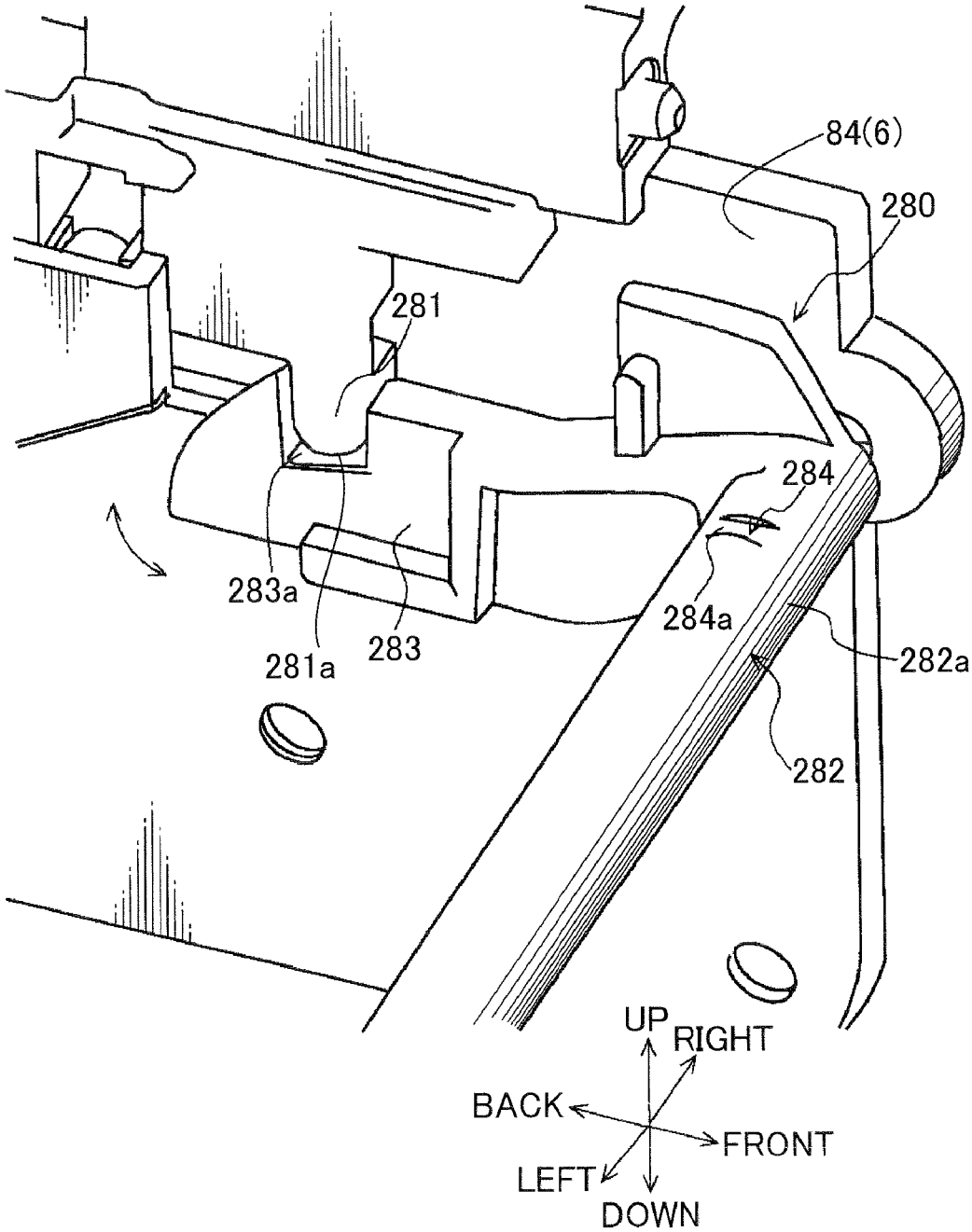
FIG. 11 is a perspective view for explanation of a shaft member, a hook member, and a cam follower portion at the side of the front cover, and an engaging member at the side of an apparatus main body in the lock member.
Figure 12:
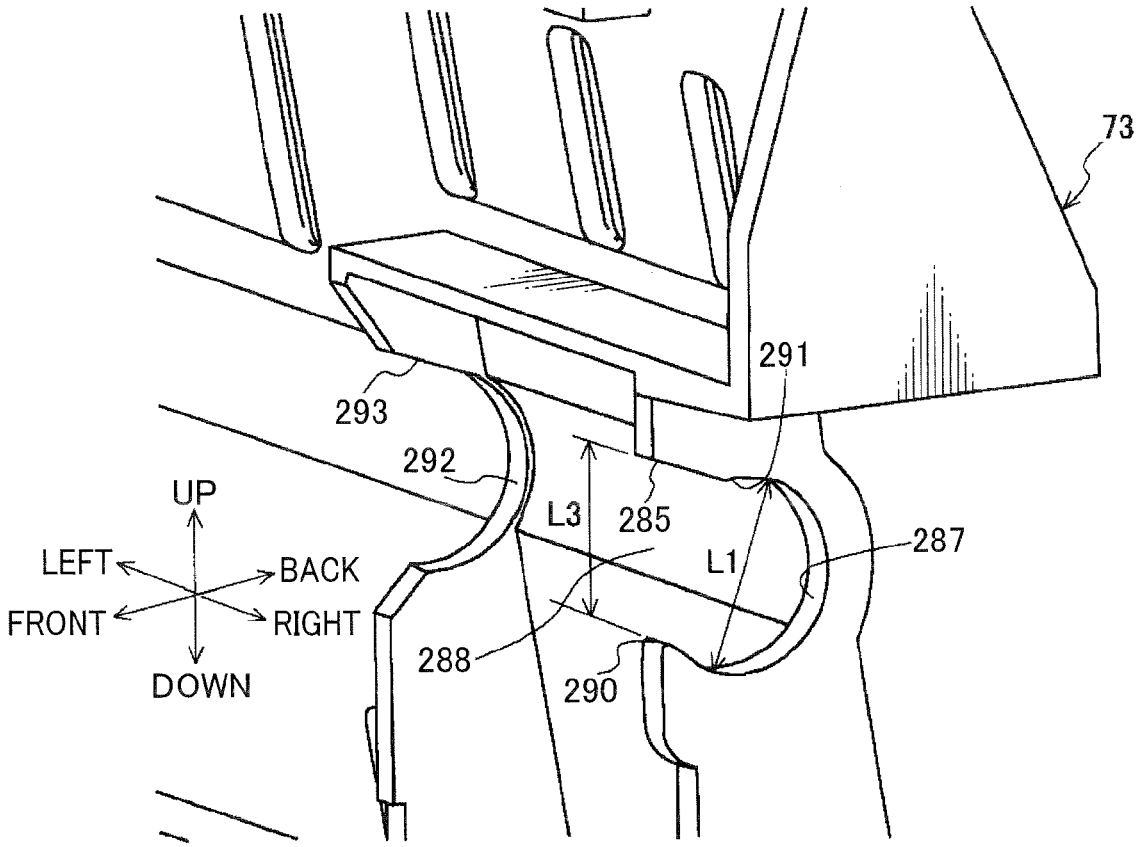
FIG. 12 is a perspective view for explanation of a catching concave portion and a cam portion formed at an entrance thereof at the side of the conveying unit.
Figure 13:
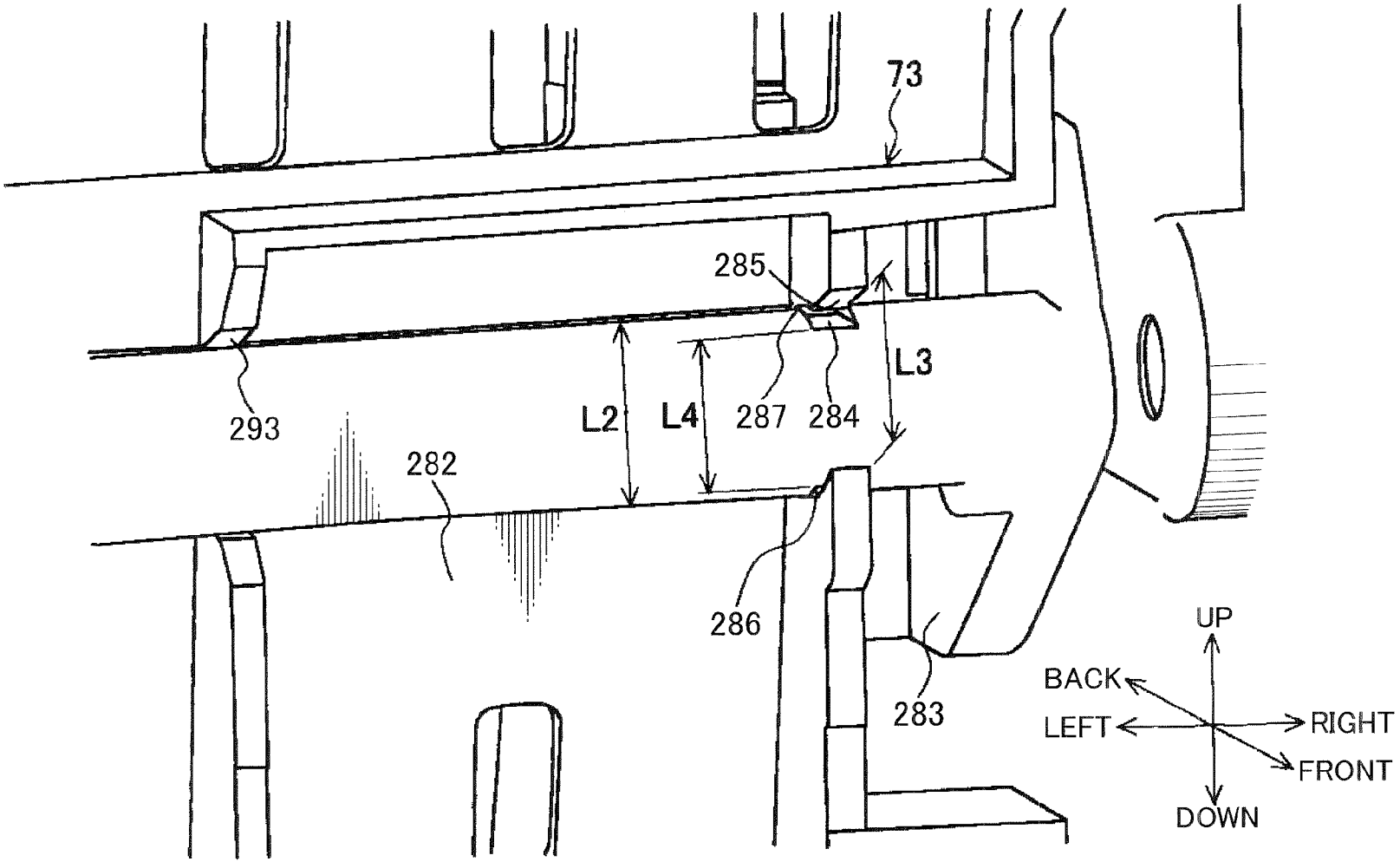
FIG. 13 is a perspective view for explanation of a state in which the shaft member is brought to make an engagement with the catching concave portion.

As illustrated in FIG. 11, the lock mechanism 280 has an engaging member 281 provided to the side of the apparatus main body 2, a shaft member 282, a hook member 283, and a cam follower portion 284 which are provided to the side of the front cover 3, and a cam portion 285 provided to the side of the conveying unit 73 as illustrated in FIGS. 12 and 13. Note that, among the above-described structure members of the lock mechanism 280, the structure members other than the shaft member 282 (corresponding to the shaft 109 in the first embodiment; refer to FIG. 8) are installed at the both of the left end side and the right end side of the apparatus main body 2. However, because those respectively have same structures, only the structure members at the right end side will be described hereinafter, and description of the structure members at the left end side will be omitted.

The engaging member 281 is structured so as to project to the inner side from the right side plate 84 structuring a part of the main body frame 6. The lower end of the engaging member 281 is composed of a curved surface 281*a* in order for a catching portion 283*a* of the hook member 283 brought to make an engagement from the lower side as will be described later, to be easy to engage therewith. This engaging member 281 is a member provided to the side of the apparatus main body 2, to serve as a reference at the time of positioning the front cover 3.

The shaft member 282, the hook member 283, and the cam follower portion 284 are integrally structured in the present embodiment. Thereamong, the shaft member 282 is installed along a horizontal direction, and the both end portions are supported rotatably by the front cover 3. When the front cover 3 disposed at the open position A2 (refer to FIG. 9) is closed, the conveying unit 73 is pushed by the front cover 3. However, in the vicinity of the closed position A1 of the front cover 3 (the closed position B1 of the conveying unit 73), the shaft member 282 directly pushes the conveying unit 73 to finally carry out positioning thereof.

The hook member 283 is provided to face substantially backward at the right end side of the shaft member 282. The catching portion 283*a* in a concave shape which is opened upward is formed at the upper portion at the rear end side of the hook member 283. This catching portion 283*a* is, as will be described later, brought to make an engagement with and detached from the engaging member 281 from a substantially lower side by rotation of the shaft member 282.

The cam follower portion 284 is formed at a slightly inner side from the hook member 283 in the shaft member 282. A planar copying surface 284*a* formed by notching a part of an outer peripheral surface 282*a* of the pillar-type shaft member 282, is formed in the cam follower portion 284. The copying surface 284*a* moves so as to follow the cam portion 285 which will be described later. Note that, as illustrated in FIG. 13, a notch 286 in a same shape as the cam follower portion 284 is formed at a side opposite to the cam follower portion 284, i.e., a position rotated by 180 degrees in a direction of the circumference of the shaft member 282. This notch 286 is to be guided to the lower side portion opposed to one another in an opening portion 288 of the catching concave portion 287 when the shaft member 282 is brought to make an engagement with the catching concave portion 287.

The shaft member 282, the hook member 283, and the cam follower portion 284 are integrally structured, and as described above, the shaft member 282 is supported rotatably by the front cover 3. Accordingly, when force is applied to the cam follower portion 284, the shaft member 282 is rotated by the force, and the hook member 283 is swung according to the rotation of the shaft member 282.

The cam portion 285 is, as illustrated in FIGS. 12 and 13, formed at an entrance of the catching concave portion 287 of the conveying unit 73. The catching concave portion 287 is formed into a shape with the opening portion 288, which has a cavity which is more like a circle rather than a semicircle in cross section. An inside diameter L1 of the catching concave portion 287 is set to be slightly greater than an outside diameter L2 of the shaft member 282. The opening portion 288 is structured between the cam portion 285 formed at the upper side and a convex guide portion 290 disposed at the lower side so as to be opposed to the cam portion 285. Positions at which these cam portion 285 and guide portion 290 are formed in a horizontal direction, i.e., positions along the longitudinal direction of the shaft member 282 are positions corresponding to the cam follower portion 284 and the notch 286 described above.

The cam portion 285 is formed into a planar shape at a slant so as to have a higher anterior end side. A width measure L3 between the cam portion 285 and the guide portion 290 is set to be less than the inside diameter L1 of the catching concave portion 287 and the outside diameter L2 of the shaft member 282, and to be slightly greater than a width measure L4 between the cam follower portion 284 and the notch 286 in the shaft member 282. Where, to organize a magnitude relation among L1 to L4, those are, in descending order, the inside diameter L1 of the catching concave portion 287, the outside diameter L2 of the shaft member 282, the width measure L3 of the opening portion 288, and the width measure L4 between the cam follower portion 284 and the notch 286, that is L1>L2>L3>L4.

Because those are set to be such a dimensional relation, when the shaft member 282 is brought to make an engagement with the catching concave portion 287, only in a case in which a direction of tilt of the cam follower portion 284 and a direction of tilt of the cam portion 285 are the same, the shaft member 282 passes through the opening portion 288 to be able to engaging with the catching concave portion 287. When the shaft member 282 is rotated at the time of engaging or after engaging, a direction of tilt of the cam follower portion 284 and a direction of tilt of the cam portion 285 are shifted, and therefore, the shaft member 282 does not drop out of the catching concave portion 287.

A convex portion 291 is formed on the boarder between the catching concave portion 287 and the cam portion 285. With respect to the shaft member 282 at the time of engaging, the hook member 283 is rotated in a direction for engaging with the engaging member 281 by the convex portion 291.

Another catching concave portion 292 is formed on the left side of the catching concave portion 287 along the horizontal direction. This catching concave portion 292 is formed into a substantially semi-circular shape, and a guide portion 293 at a slant in a same direction as the cam portion 285 is provided to the upper end side. The guide portion 293 is to guide the outer peripheral surface of the shaft member 282 at the time of engaging.

Operations of the lock mechanism 280, in particular, operations for engaging the hook member 283 with respect to the engaging member 281 will be described with reference to FIGS. 9A and 9B, FIG. 10, and FIGS. 14A to 14C.

As described above on the basis of FIG. 9B, in a state in which the front cover 3 is disposed at the open position A2, and the conveying unit 73 is disposed at the open position B2, the sheet conveying path 52 and the sheet reconveying path 53 are opened. FIG. 10 illustrates this state. By moving the front cover 3 at the open position A2 toward a direction of an arrow R3*b* of FIG. 10, it is possible to make the front cover 3 move toward the closed position A1 illustrated in FIG. 9A. At this time, the front cover 3 presses up the conveying unit 73 at the open position B2 in process of the closing operation.

Figure 14A:
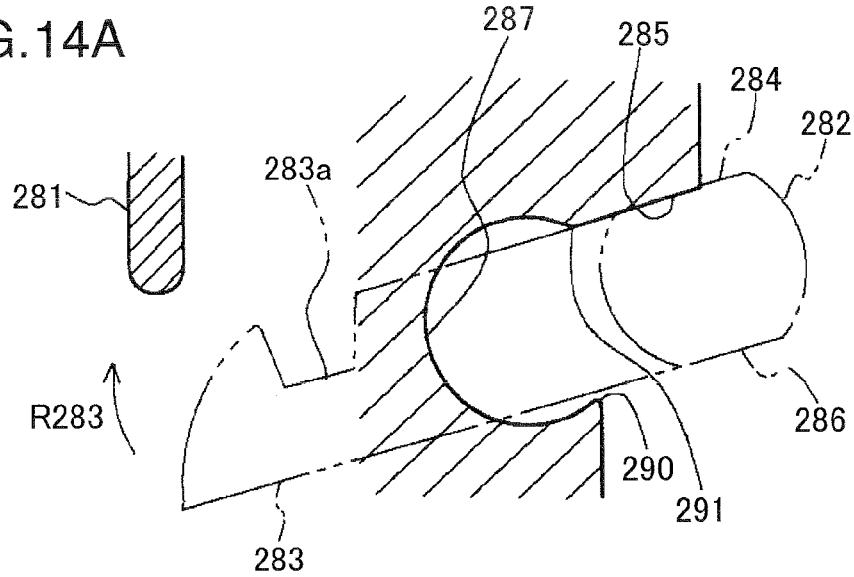
FIGS. 14A to 14C are operational explanatory diagrams schematically illustrating statuses in which the shaft member is brought to make an engagement with the catching concave portion, and the hook member is brought to make an engagement with the engaging member.

Namely, as illustrated in FIG. 10, a contacting part 294 at the side of the front cover 3 contacts a contacting part 295 at the side of the conveying unit 73 to press up it so as to lift up from the lower side, which makes the conveying unit 73 at the open position B2 move toward the closed position B1. Then, as the front cover 3 approaches the closed position A1 and the conveying unit 73 approaches the closed position B1, in place of the contacting parts 294 and 295 at the side of the front cover 3 and the side of the conveying unit 73 which have come into contact with each other so far, as illustrated in FIG. 14A, the cam follower portion 284 of the shaft member 282 at the side of the front cover 3 and the cam portion 285 at the entrance of the catching concave portion 287 at the side of the conveying unit 73 come into contact with each other.

Figure 14B:
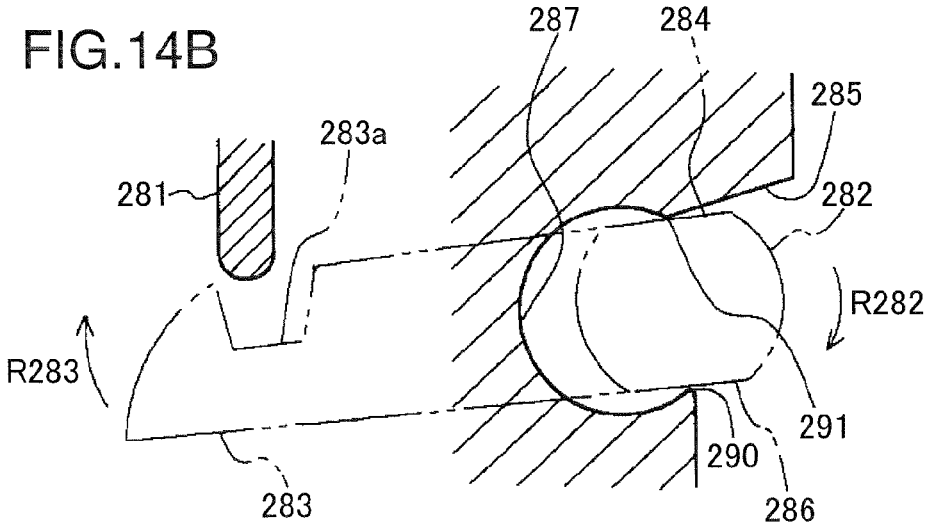
Figure 14C:
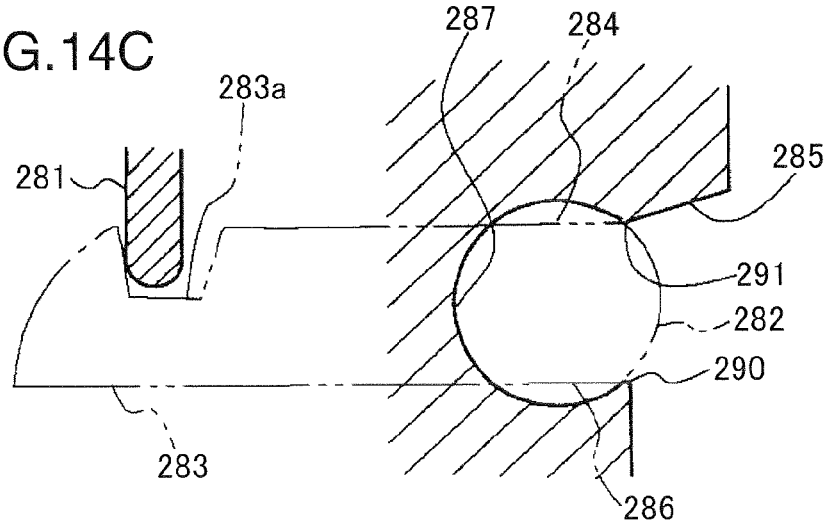

In this state, when the front cover 3 further moves toward the closed position A1, the shaft member 282 moves such that the cam follower portion 284 is guided by the cam portion 285, and the cam follower portion 284 and the notch 286 pass though the opening portion 288. When the cam follower portion 284 passes through the convex portion 291 on the boarder between the cam portion 285 and the catching concave portion 287, as illustrated in FIG. 14B, the cam follower portion 284 is inclined centering on the convex portion 291, and moment in a direction of an arrow R282 is applied to the shaft member 282. Due to this moment, moment in a direction of an arrow R283, i.e., a direction of engaging with respect to the engaging member 281 is applied to the hook member 283 integrated with the shaft member 282. Then, as illustrated in FIG. 14C, at substantially the same time when the shaft member 282 is brought to make an engagement with the catching concave portion 287, the catching portion 283*a* of the hook member 283 is brought to make an engagement with the engaging member 281.

The shaft member 282 brought to make an engagement with the catching concave portion 287 as described above is in an engagement in a state of being rotated slightly from an angle at which the cam follower portion 284 and the notch 286 can pass through the opening portion 288. Therefore, unless directions of the cam follower portion 284 and the notch 286, and a direction of the opening portion 288 are made to match to one another by rotating the shaft member 282 from the outside, there are no cases in which the shaft member 282 drops out of the catching concave portion 287. Namely, there are no cases in which the engaging state (lock state) of the hook member 283 with respect to the engaging member 281 is released.

In accordance with the above operations, the front cover 3 is positioned at the closed position A1 with respect to the apparatus main body 2, and further, the conveying unit 73 is positioned at the closed position B1. Note that, in order to release the engaging state (lock state) of the hook member 283 with respect to the engaging member 281, the buttons 93 of the release levers 80 described in the first embodiment should be pulled toward the front side. Thereby, the hook member 283 is rotated in a releasing direction opposite to the engaging direction via the connecting member 88 (refer to FIG. 8 and the like) to which the hook member 283 is connected, and the engagement of the hook member 283 is released, which makes it possible to open the front cover 3. The hook member 283 whose engagement is released is held at a position to release the engagement illustrated in FIG. 14A by a restricting member (not shown) such as a stopper.

In accordance with the image forming apparatus 1A according to the second embodiment described above, because the hook member 283 to position the front cover 3 with respect to the apparatus main body 2 and the shaft member 282 to position the conveying unit 73 with respect to the apparatus main body 2 are integrally structured, it is possible to improve an accuracy of positioning of the front cover 3 and the conveying unit 73 with respect to the apparatus main body 2. Thereby, it is possible to appropriately set nip pressures at the pair of registration rollers 57, the driving roller 43 and the secondary transfer roller 45, and the pairs of reconveying rollers 70 and 71 illustrated in FIG. 9A, which makes it possible to smoothly convey a sheet.

Further, the engaging member 281 at the side of the image forming apparatus main body 2 serving as a reference for positioning of the front cover 3, and the shaft member 282 serving as a reference for positioning of the conveying unit 73 are located at substantially a same height at the closed position A1 of the front cover 3 and the closed position B1 of the conveying unit 73. Or, the engaging member 281 at the side of the apparatus main body 2 is substantially located on a circumference with a radial of a length from the pivot point 85 of the front cover 3 serving as a reference up to the center of the shaft member 282. It is possible to improve an accuracy of positioning thereby as well.

Moreover, the cam follower portion 284 is provided to the shaft member 282, and the cam portion 285 is provided to the conveying unit 73. Therefore, shortly before the front cover 3 is moved from the open position A2 toward the closed position A1 to bring the shaft member 282 into making an engagement with the catching concave portion 287, moment to rotate the hook member 283 toward the engaging direction is applied to the shaft member 282 by the cam follower portion 284 and the cam portion 285, and the catching portion 283*a* of the cam member 283 is brought to make an engagement with the engaging member 281. Accordingly, a biasing member such as an extension spring to bias the hook member 283 to the engaging direction is omitted positively, and it is possible to simplify the structure by that much.

In the second embodiment, the example that the cam follower portion 284 is provided to the side of the shaft member 282, and the cam portion 285 is provided to the side of the conveying unit 73 has been described. In contrast thereto, a cam portion may be provided to the side of the shaft member 282, and a cam follower portion may be provided to the side of the conveying unit 73. Namely, provided that a cam follower portion disposed in one side and a cam portion disposed in the other side between the front cover 3 and the conveying unit 73 come into contact with each other by an operation of closing the front cover 3, and the both relatively move, which makes it possible to generate moment to rotate the hook member 283 to the engaging direction with respect to the shaft member 282, any structure can be employed in which a cam follower portion and a cam portion are disposed in any one of the front cover 3 and the conveying unit 73.

Third Embodiment

Figure 15:
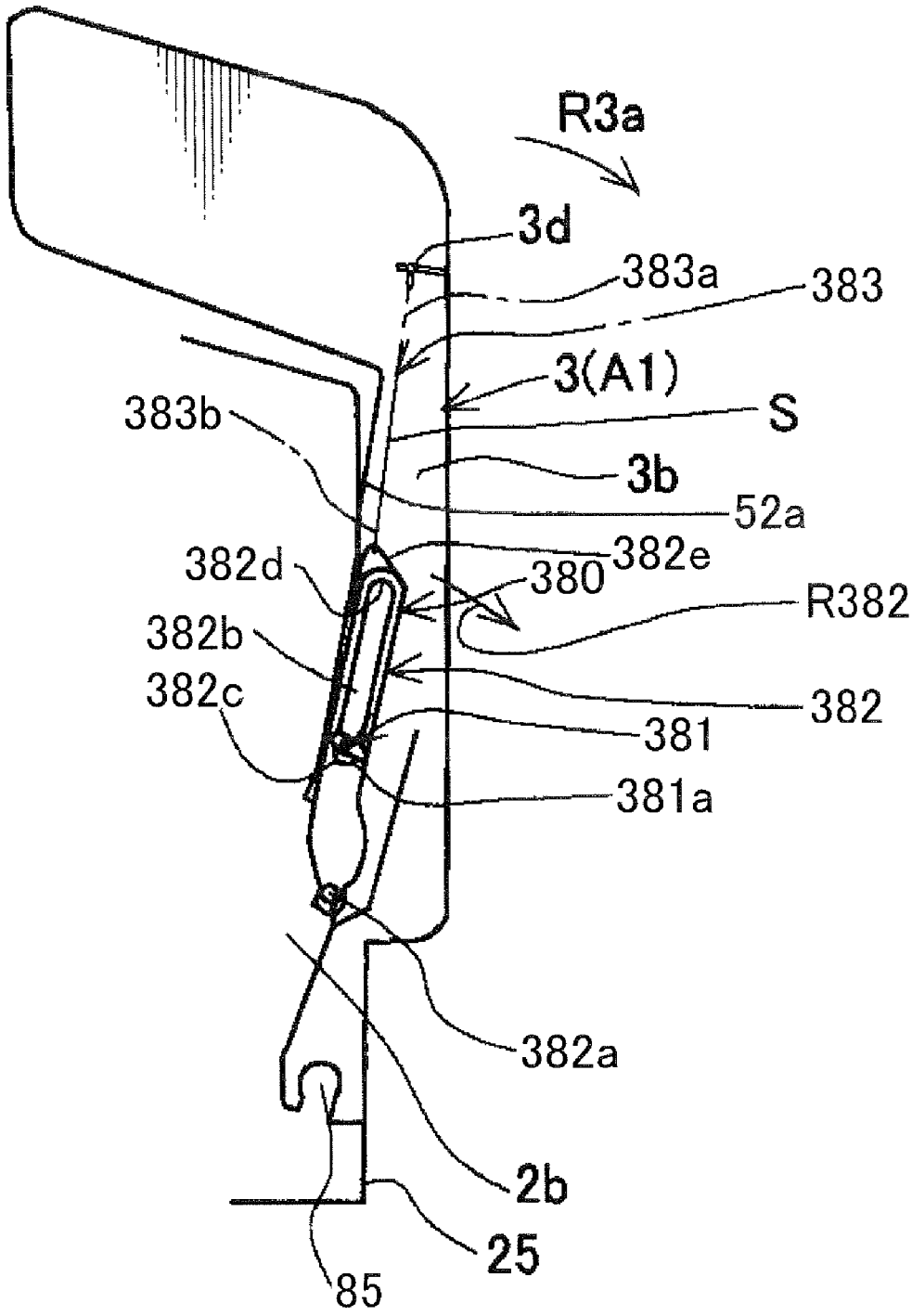
FIG. 15 is a left side view illustrating a state of an opening and closing aid mechanism according to a third embodiment of the present invention, when the front cover is disposed at a closed position.
Figure 16:
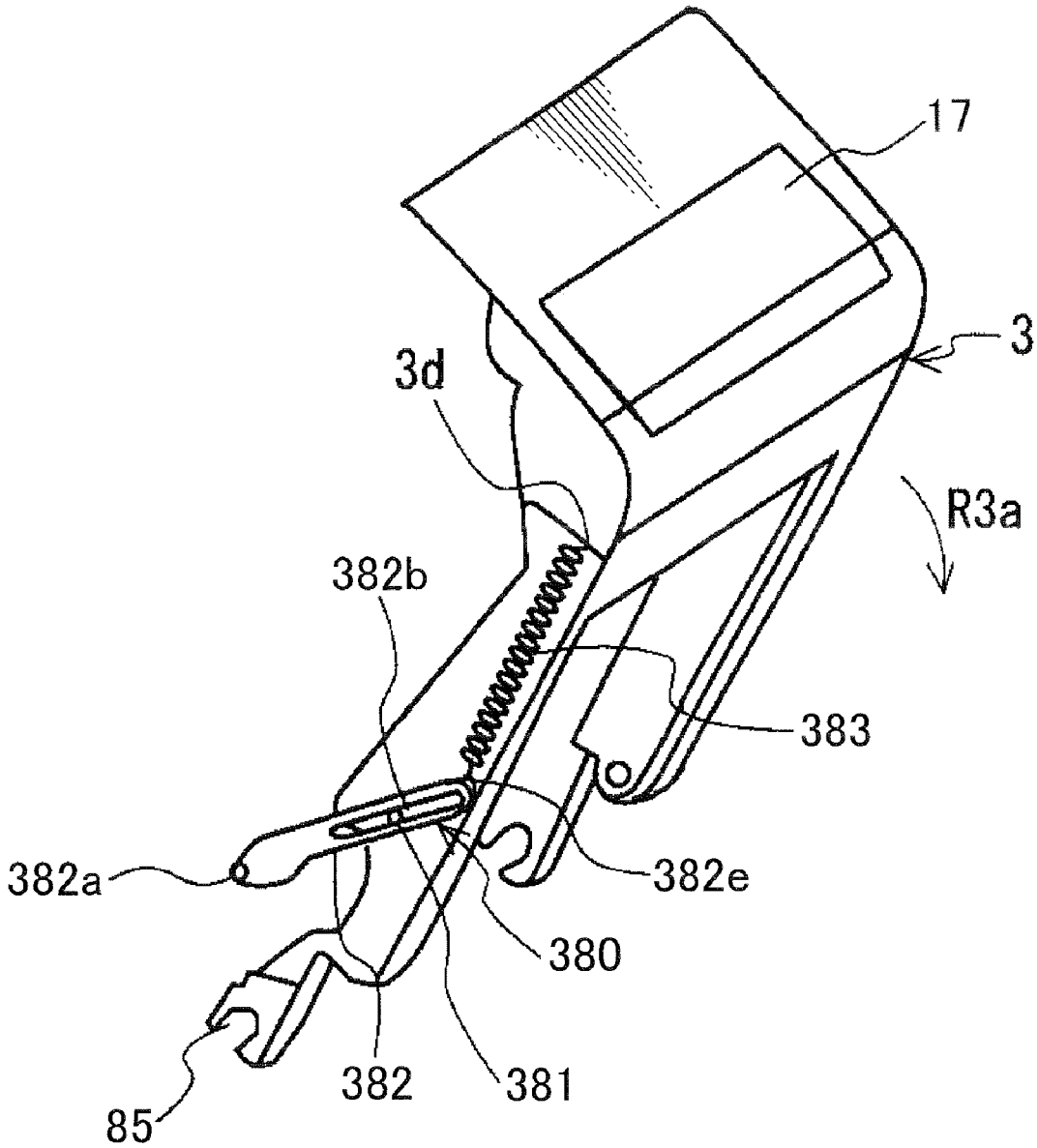
FIG. 16 is a perspective view illustrating a state of the opening and closing aid mechanism when the front cover is disposed substantially an intermediary position between the closed position and an open position.
Figure 17:
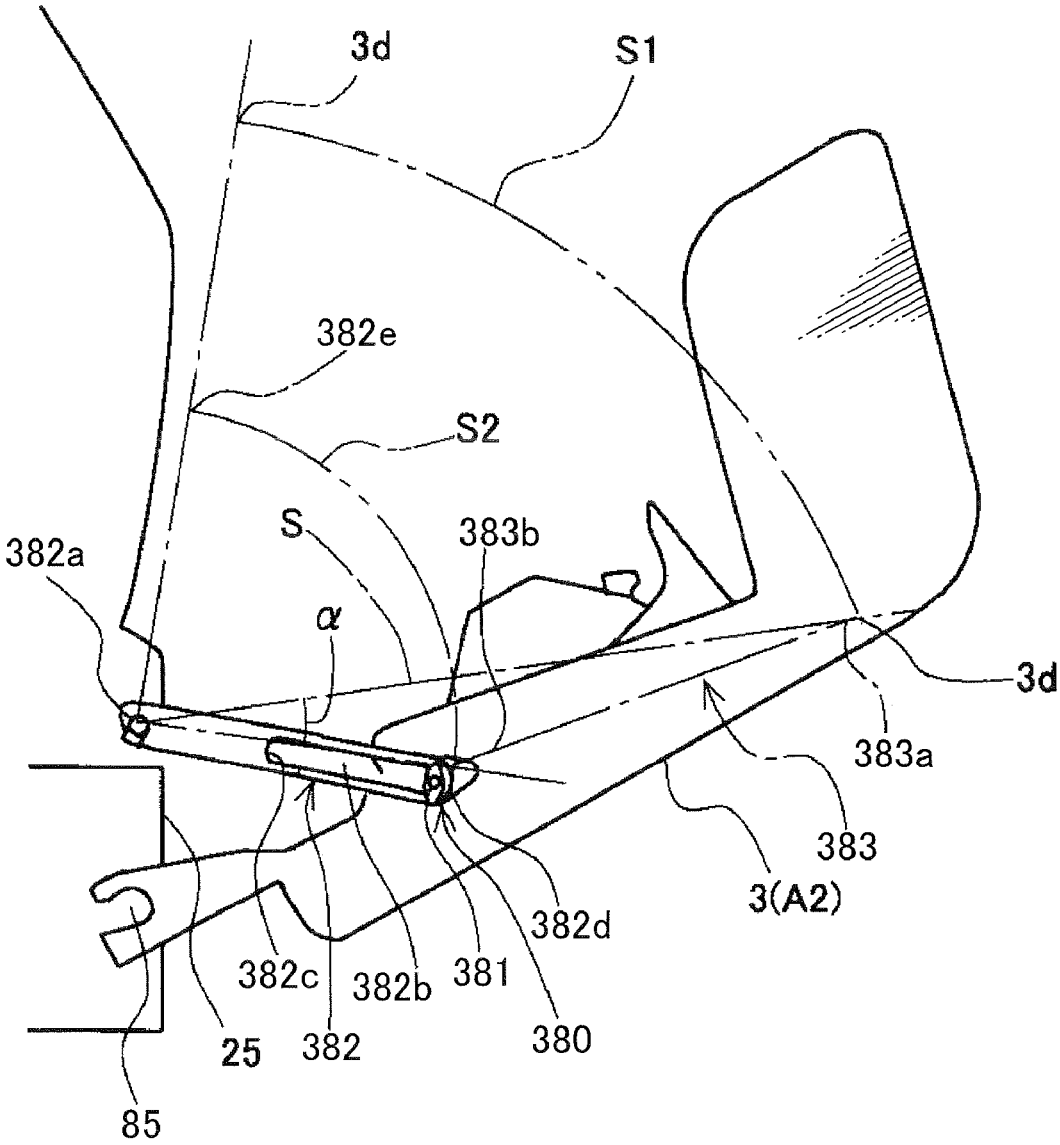
FIG. 17 is a left side view illustrating a state of the opening and closing aid mechanism when the front cover is disposed at the open position.

In a third embodiment, an embodiment in which an opening and closing aid mechanism 380 to bias the front cover 3 toward a direction of a closed position is provided, will be described. The opening and closing aid mechanism 380 is installed between the apparatus main body 2 and the front cover 3. Hereinafter, the opening and closing aid mechanism 380 will be described with reference to FIGS. 15 to 17. Thereamong, FIG. 15 is a left side view illustrating a state of the opening and closing aid mechanism 380 when the front cover 3 is disposed at the closed position A1 (refer to FIG. 9A). FIG. 16 is a perspective view illustrating a state of the opening and closing aid mechanism 380 when the front cover 3 is disposed at a substantially intermediate position between the closed position A1 and the open position A2 (refer to FIG. 9B). FIG. 17 is a left side view illustrating a state of the opening and closing aid mechanism 380 when the front cover 3 is disposed at the open position A2.

The opening and closing aid mechanism 380 has a guide member 381 fixed to the front cover 3, a holding link 382 having a pivot point 382*a* at the side of the apparatus main body 2, and an extension spring 383 connecting the holding link 382 and the front cover 3.

The guide member 381 is, as illustrated in FIG. 15, fixed to a portion slightly lower than a substantially intermediate position in a vertical direction on a side surface 3*b* of the front cover 3, and has a guide pin (not shown) moving so as to follow a guide groove 382*b* of the holding link 382, and a rectangular retaining portion 381*a* fixed to a head portion of the guide pin to prevent the holding link 382 from dropping off. Note that the side surface 3*b* of the front cover 3 is to be exposed by detaching the left panel 14 from the front cover 3 illustrated in FIG. 4.

The holding link 382 is formed of a laminar long member, and the pivot point 382*a* of the base end portion is supported pivotally by an attaching portion 2*b* at the side of the apparatus main body 2. The attaching portion 2*b* is located at the lower end side of an anterior surface 2*a* of the apparatus main body 2. Further, a position of the attaching portion 2*b* corresponds to an upper side of the anterior surface of the paper feed cassette 25 in a state of being housed in the apparatus main body 2, and the pivot point 85 of the front cover 3 is located below the attaching portion 2*b*.

The guide groove 382*b* is formed in the leading end side (the upper end side in FIG. 15) of the holding link 382. The guide groove 382*b* is formed from a substantially intermediate position in the longitudinal direction up to the leading end side of the holding link 382, and a groove width thereof is set to be slightly wider than a diameter of the guide pin of the guide member 381 at the side of the front cover 3, and narrower than a length at the long side of the retaining portion 381*a*. The guide pin is capable of relatively moving along the guide groove 382*b*, and when the front cover 3 is disposed at the closed position A1, the guide pin is located at an end portion 382*c* at the base end side of the guide groove 382*b*, and when the front cover 3 is disposed at the open position A2 as illustrated in FIG. 17, the guide pin is located at an end portion 382*d* at the leading end side. A connecting portion 382*e* is provided in the vicinity of the end portion at the leading end side of the guide groove 382*b* in the holding link 382. Other end portion 383*b* of the extension spring 383 which will be described later is connected to the connecting portion 382*e*.

The extension spring 383 connects the holding link 382 and the front cover 3. With respect to the extension spring 383, a one end portion 383*a* located at the upper end side in FIG. 15 is connected to a connecting portion 3*d* at the upper end side of the side surface 3*b* of the front cover 3, and the other end portion 383*b* is connected to a connecting portion 382*e* at the side of the holding link 382. Spring force of the extension spring 383 is set to an extension that, when the front cover 3 is disposed at the open position A2 illustrated in FIG. 17, the extension spring 383 becomes a maximum length, and even at that time, it is possible to bias the front cover 3 toward the closing direction, but not enough to move the front cover 3 from the open position A2.

In the present embodiment, a target to which the other end portion 383*b* of the extension spring 383 is connected is set to, not the side of the apparatus main body 2, but the holding link 382 supported pivotally by the apparatus main body 2. Therefore, it is possible to restrict a moving range of the extension spring 383 according to opening and closing of the front cover 3 within an area occupied by the side surface 3*b* at a time of facing to view the side surface 3*b* of the front cover 3. Thereby, for example, when the front cover 3 is disposed at the open position A2 in order to remove a jammed paper generated in the sheet conveying path 52 or the sheet reconveying path 53 (refer to FIG. 3), there are no cases in which the extension spring 383 gets in the way of a work for removing the jammed paper.

With respect to the opening and closing aid mechanism 80, as illustrated in FIG. 15, when front cover 3 is disposed at the closed position A1, the holding link 382 takes a substantially standup position so as to locate its leading end side slightly forward, and the extension spring 383 as well is provided to stretch in substantially the same direction as the holding link 382. The guide member 381 integrated with the front cover 3 is located at the end portion 382*c* at the base end side of the guide groove 382*b*. At this time, given that a straight line connecting the pivot point 382*a* of the holding link 382 and the connecting portion 3*d* at the side of the front cover 3 is a virtual straight line S, the guide member 381 integrated with the front cover 3 and the connecting portion 382*e* at the side of the holding link 382 are substantially on the virtual straight line S.

Further, the pivot point 85 of the front cover 3 is to be an extension of the virtual straight line S to be extended downward. In other words, in order of the lower side, the pivot point 85 of the front cover 3, the pivot point 382*a* of the holding link 382, the guide member 381, the connecting portion 382*e* of the holding link 382, and the connecting portion 3*d* of the front cover 3 are substantially on the virtual straight line S. Accordingly, in this state, the extension spring 383 becomes a minimum length (extends at minimum), which does not generate force to bias the front cover 3 toward the closing direction. Therefore, when the operator starts opening the front cover 3, the extension spring 383 does not get in no way.

Here, when paper jam is caused in the sheet conveying path 52 or the sheet reconveying path 53, the operator opens the front cover 3 in order to remove the jammed paper. It is possible for the operator to start opening the front cover 3 by releasing the locking by operating the buttons 93 of the release levers 80 described above in the first embodiment. Thereby, as illustrated in FIG. 15, the upper end side of the front cover 3 is swung in a direction of an arrow R3*a* centering on the pivot point 85 at the lower end side. According to this, the guide member 381 integrated with the front cover 3 rotates in the same direction, and the holding link 382 is rotated so as to fall in a direction of an arrow R382 centering on the pivot point 382*a* by the guide member 381.

Then, the front cover 3 passes through a state of being half opened illustrated in FIG. 16, to change its position to a state of being completely opened illustrated in FIG. 17, i.e., the open position A2. In FIG. 17, a trajectory S1 of the connecting portion 3*d* at the side of the front cover 3 and a trajectory S2 of the connecting portion 382*e* at the side of the holding link 382 during the movement of front cover 3 from the closed position A1 up to the open position A2 are illustrated. As shown in the drawing, the pivot point 382*a* at the side of the holding link 382 is located superior to the pivot point 85 at the side of the front cover 3, and a distance from the pivot point 382*a* up to the connecting portion 382*e* of the holding link 382 is shorter than a distance from the pivot point 85 to the connecting portion 3*d* of the front cover 3.

Therefore, given that an angle at which a straight line connecting the pivot point 382*a* and the connecting portion 382*e* is against the virtual straight line S connecting the pivot point 382*a* at the side of the holding link 382 and the connecting portion 3*d* at the side of the front cover 3, is an inclined angle $\alpha$ of the holding link 382 against the front cover 3, the relationship is made such that the inclined angle $\alpha$ is 0 degree when the front cover 3 is disposed at the closed position A1, and becomes a maximum when the front cover 3 is disposed at the open position A2, and between the closed position A1 and the open position A2, the greater the open angle of the front cover 3 is, the greater the inclined angle $\alpha$ becomes. In the same way, the greater the open angle of the front cover 3 is, the greater the distance between the connecting portion 3*d* at the side of the front cover 3 and the connecting portion 382*e* at the side of the holding link 382 becomes, which makes extension of the extension spring 383 greater.

When the front cover 3 is disposed at the closed position A1, the inclined angle α is 0 degree, and a length (extension) of the extension spring 383 becomes a minimum. The greater the open angle of the front cover 3 is, the greater the inclined angle α becomes, which makes a length (extension) of the extension spring 383 greater. Then, when the front cover 3 is disposed at the open position A2, both of the inclined angle α the length (extension) of the extension spring 383 are maximized. When the extension spring 383 pulls the holding link 382 at the inclined angle α, it is possible to bias the guide member 381 toward the closing direction of the front cover 3 via the holding link 382. This biasing force is, in principle, generated when the holding link 382 is at the inclined angle α, i.e., when the front cover 3 is opened even slightly from the closed position A1.

In this way, in the present embodiment, it is possible to apply biasing force in the closing direction to the front cover 3 over the entire moving range of the front cover 3, i.e., the entire region from the closed position A1 to the open position A2, even with a simple structure. Moreover, when an open angle of the front cover 3 is made greater, the greater the own weight of the front cover 3 is loaded on the operator, the greater the biasing force becomes.

Accordingly, because load to be supported by his or her own hands during an opening and closing operation of the front cover 3 is reduced, it is possible for the operator to lightly carry out opening and closing of the front cover 3. Further, for example, even when the operator unlinks his or her own hands from the front cover 3 during an opening and closing operation of the front cover 3, because the front cover 3 is biased in the closing direction, even in a case in which the front cover 3 is opened to the open position A2 against the biasing force, it is possible to cushion the shock, and prevent the holding link 3, the guide member 381, and the like from being damaged. Accordingly, provided that part of the sheet conveying paths is built into the front cover 3, it is useful especially for a case in which its own weight of the front cover 3 is heavy.

Further, the guide member 381 and the holding link 382 structuring the opening and closing aid mechanism 380 function as stoppers to retain the front cover 3 at the open position A2. Accordingly, with respect to the image forming apparatus which has already a same shaped holding link, it is possible to construct the opening and closing aid mechanism 380 by merely adding the above-described extension spring 383.

In the above-described third embodiment, the opening and closing aid mechanism 380 has been described by using a case in which the opening and closing aid mechanism 380 is disposed at the left end side of the front cover 3, as an example. Instead of that, the opening and closing aid mechanism 380 may be disposed at the right end side of the front cover 3, or both of the left end side and the right end side of the front cover 3.

Note that the invention having the following structures is mainly included in the above-described specific embodiments.

An image forming apparatus according to an aspect of the present invention comprising: an image forming unit which forms an image on a sheet; a sheet conveying section which conveys the sheet on which the image is formed; an apparatus main body in which the image forming unit and the sheet conveying section are installed; an operating unit to input operational information; a front cover to which the operating unit is mounted to be supported in a freely openable/closable manner by the apparatus main body, the front cover is capable of changing in position between a closed position to cover an anterior surface side of the apparatus main body and an open position to expose a part of the apparatus main body; and a retention mechanism which includes a lock member and a release member, the retention mechanism retains the front cover at the closed position with respect to the apparatus main body, wherein the lock member is a member which is supported by one of the apparatus main body and the front cover so as to be capable of making an engagement with and being detached from the other one, and the release member is a member to release engagement of the lock member, and the release member is installed at a region located posterior to the operating unit and a region facing a back surface side as viewed from an opening and closing direction of the front cover.

In this case, it is preferable that the front cover is supported at its lower end side in a freely openable/closable manner by the apparatus main body, and is opened such that its upper end side is separated away from the apparatus main body at the open position, the operating unit is disposed at the upper end side of the front cover, and the release member is installed at a side posterior to the operating unit at the upper end side of the front cover.

According to such an image forming apparatus, it is difficult to view the release member from a front surface side (the opening and closing direction of the front cover) of the image forming apparatus, where an operator is located at the time of operating the operating unit, and it is possible to hard to carry out an incorrect operation.

In the above-described structure, it is preferable that the release member is disposed within an operating range in which it is possible for an operator operating the operating unit at a front surface side opposed to the front cover of the apparatus main body to operate the release member. According to this structure, when the operator makes an attempt to operate the release member positively with the intention of operating it, it is possible for the operator to easily operate it without moving especially from the front surface side.

In the above-described structure, it is preferable that a direction of operating the release member by the operator at the time of releasing the engagement of the lock member and the opening and closing direction of the front cover are substantially the same. According to this structure, it is possible for the operator to smoothly carry out an operation of the release member to an operation of opening the front cover as a series of operations along a same direction.

In the above-described structure, it is preferable that the sheet conveying section has a sheet conveying path which is disposed at the anterior surface side of the apparatus main body, to convey the sheet therethrough, the front cover has a guide portion structuring a part of the sheet conveying path when the front cover is disposed at the closed position, and when the front cover is moved to the open position, the sheet conveying path is opened. According to this structure, when the front cover is opened, it is possible to easily open the part of the sheet conveying path according to this without any special opening operation.

In the above-described structure, it is preferable that a paper discharge tray which is provided at a superior surface of the apparatus main body, and to which a sheet after image formation is discharged, and a sheet discharge opening which is provided at a position at which an upper end side back surface of the front cover exists, and from which a sheet after image formation is discharged toward the paper discharge tray, are further included, and the release member is disposed at a peripheral portion of the sheet discharge opening. According to this structure, it is possible to make the release member hard to be viewed from the front surface side, which is further hard to carry out an incorrect operation.

In this case, it is more preferable that the release members are disposed at a left side and a right side of the sheet discharge opening, which makes it possible to release the lock member by operating one of the release members. According to this structure, it is possible for the operator to release the lock member by operating at least one, which is easier to operate, of the release members.

In the above-described structure, it is preferable that the lock member is a lock member assembly supported by the front cover, the lock member assembly includes the following; a slide member which is a rod-like member having a first end portion and a second end portion, the slide member is capable of sliding by applying pressing force to the first end portion from the release member; a rotary member with which the second end portion of the slide member is brought into contact, the rotary member rotates by the sliding; a hook member which makes an engagement with and is detached from a predetermined engaging member provided to the apparatus main body; and a connecting member in a belt shape having a first connecting portion to be connected to the rotary member and a second connecting portion to be connected to the hook member. According to this structure, it is possible to install the front cover in a mode in which the lock member is simple and does not take up much space.

In the above-described structure, it is preferable that the sheet conveying section has a sheet conveying path which is disposed at the anterior surface side of the apparatus main body, to convey the sheet therethrough, and image forming apparatus further includes a conveying unit whose lower end side is supported swingablly by the apparatus main body, the conveying unit is capable of changing in position between a closed position to structure a part of the sheet conveying path by being interposed between the front cover disposed at the closed position and the anterior surface side of the apparatus main body, and an open position to open the sheet conveying path according to opening of the front cover.

In particular, it is preferable that the sheet conveying section has a sheet conveying path which is disposed at the anterior surface side of the apparatus main body, to convey the sheet therethrough, and image forming apparatus further includes a conveying unit whose lower end side is supported pivotally by the apparatus main body, the conveying unit is capable of changing in position between a closed position to structure a part of the sheet conveying path by being interposed between the front cover disposed at the closed position and the anterior surface side of the apparatus main body, and an open position to open the sheet conveying path according to opening of the front cover, and an engaging member provided to the apparatus main body, and the lock member is a lock member assembly including the following; a shaft member which is installed along a horizontal direction at a side of the front cover, and the shaft member presses to position the conveying unit at the closed position when the front cover is moved from the open position to the closed position; and a hook member which is structured integrally with the shaft member, and is capable of making an engagement with and being detached from the engaging member, the hook member positions the front cover at the closed position at a time of engaging.

According to this structure, the front cover is positioned at the closed position with respect to the apparatus main body by making the hook member of the lock member assembly engage with the engaging portion at the side of the apparatus main body. Further, the conveying unit is positioned at the closed position with respect to the apparatus main body by the shaft member integrated with the hook member of the lock member assembly. Namely, because the front cover and the conveying unit are respectively positioned at the closed position and the closed position with respect to the apparatus main body by the hook member and the shaft member integrated with one another, it is possible to position the front cover and the conveying unit with respect to the apparatus main body with high accuracy.

In the above-described structure, it is preferable that the conveying unit has a catching concave portion to position the conveying unit at the closed position by making an engagement with the shaft member in a state in which the front cover is disposed at the closed position. According to this structure, it is possible to secure relative positioning accuracy of the front cover and the conveying unit with high accuracy by making an engagement between the shaft member and the catching concave portion.

In the above-described structure, it is preferable that the hook members are respectively installed at both ends of the shaft member, and the engaging members are installed at positions corresponding to the respective hook members at the side of the apparatus main body. According to this structure, it is possible to prevent the front cover and the conveying unit from being disposed at the closed position and the closed position in a state in which the left end sides and the right end sides are shifted.

In the above-described structure, it is preferable that a cam portion formed at one of an entrance of the catching concave portion at the side of the conveying unit and the shaft member, and a cam follower portion formed at the other one are included, the cam portion and the cam follower portion are configured to rotate the hook member toward an engaging direction via the shaft member due to the cam portion and the cam follower portion contacting to have relative movement when the front cover is moved from the open position to the closed position. According to this structure, it is possible to smoothly make the hook member make an engagement with the engaging member without providing a biasing member such as a spring.

In the above-described structure, it is preferable that the sheet conveying section has a first sheet conveying path structured between the conveying unit disposed at the closed position and the anterior surface side of the apparatus main body, and a second sheet conveying path, which is formed between the conveying unit disposed at the closed position and the front cover, to guide a sheet after image formation again to the image forming unit.

According to this structure, it is possible to secure high positioning accuracy of the first and second sheet conveying paths. Therefore, for example, in a case in which pairs of conveying rollers are disposed at a sheet conveying path and a sheet reconveying path, and the pairs of conveying rollers are composed pairs of rollers which are separated away from each other in an open state of the front cover and an open state of the conveying unit, it is possible to set nip pressures of conveying nips of the pairs of conveying rollers when the front cover is disposed at the closed position, and the conveying unit is disposed at the closed position, to be appropriate levels, which makes it possible to smoothly convey a sheet.

In the above-described structure, it is preferable that an opening and closing aid mechanism which is installed between the apparatus main body and the front cover, to aid an opening and closing operation of the front cover, the opening and closing aid mechanism includes the following; a guide member provided to project to a side surface of the front cover; a holding link whose base end portion is supported pivotally by the apparatus main body, and which has a guide groove in a long hole shape to guide a movement of the guide member at a side of a leading end, the holding link holds the front cover at the open position by bringing the guide member into contact with the leading end of the guide groove; and an extension spring whose one end portion is connected to the side surface of the front cover, and whose other end portion is connected to the holding link, the extension spring biases the front cover toward a closing direction via the guide member by biasing the holding link.

According to this structure, with a simple structure in which the holding link supported pivotally by the apparatus main body is biased by the extension spring, it is possible to effectively bias the front cover toward the closing direction over the entire area of a moving range of the front cover. Further, for example, because it is possible to dispose the holding link in the vicinity of the base end portion (lower end side) of the front cover, it is possible to make a structure hard to be in the way at the time of opening the front cover as compared with a structure in which the apparatus main body and the front cover are connected with an extension spring.

In the above-described structure, it is preferable that, with respect to the extension spring, the one end portion is connected to the upper end side of the front cover, and the other end portion is connected to the leading end side of the holding link. According to this structure, because the other end portion of the extension spring is connected to a position distant from the base end portion serving as a center of swinging of the holding link, as compared with a case in which the extension spring is connected to a position near the base end portion, it is possible to bias the cover member toward the closing direction by great force.

In the above-described structure, it is preferable that an operating range of the extension spring is limited within an area occupied by the side surface at a time of facing to view the side surface of the front cover. According to this structure, there is no risk that the extension spring is in the way when the cover member is opened.

An image forming apparatus according to another aspect of the present invention, comprising: an image forming unit which forms an image on a sheet; a sheet conveying section which conveys the sheet on which the image is formed; an apparatus main body in which the image forming unit and the sheet conveying section are installed; a front cover which is supported in a freely openable/closable manner by the apparatus main body, the front cover is capable of changing in position between a closed position to cover an anterior surface side of the apparatus main body and an open position to expose a part of the apparatus main body; and a retention mechanism which includes a lock member and a release member, the retention mechanism retains the front cover at the closed position with respect to the apparatus main body, wherein the front cover has front face panels located at outer side surfaces, and the front face panels includes an anterior panel and an upper panel continuing to an upper end of the anterior panel, the lock member is a member which is supported by one of the apparatus main body and the front cover so as to be capable of making an engagement with and being detached from the other one, and the release member is a member to release engagement of the lock member, and the release member is installed at a back surface side of the upper panel as viewed from an opening and closing direction of the front cover.

This application is based on patent application Nos. 2007-105666, 2007-134915 and 2007-155930 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. An image forming apparatus comprising:

an image forming unit which forms an image on a sheet;

a sheet conveying section which conveys the sheet on which the image is formed;

an apparatus main body in which the image forming unit and the sheet conveying section are installed;

an operating unit to input operational information;

a front cover to which the operating unit is mounted so that the operating unit is disposed at an upper end side of the front cover, the front cover being supported in a freely openable/closable manner by the apparatus main body, the front cover is capable of changing in position between a closed position to cover an anterior surface side of the apparatus main body and an open position to expose a part of the apparatus main body so that the upper end side of the front cover is separated away from the apparatus main body at the open position; and a retention mechanism which includes a lock member and a release member, the retention mechanism retains the front cover at the closed position with respect to the apparatus main body, wherein the lock member is a member which is supported by one of the apparatus main body and the front cover so as to be capable of making an engagement with and being detached from the other one, and the release member is a member to release engagement of the lock member, and the release member is installed at a region located posterior to the operating unit at the upper end side of the front cover and a region facing a back surface side as viewed from an opening and closing direction of the front cover.

2. The image forming apparatus according to claim 1, wherein the release member is disposed within an operating range in which it is possible for an operator operating the operating unit at a front surface side opposed to the front cover of the apparatus main body to operate the release member.

3. The image forming apparatus according to claim 2, wherein a direction of operating the release member by the operator at the time of releasing the engagement of the lock member and the opening and closing direction of the front cover are substantially the same.

4. The image forming apparatus according to claim 1, wherein the sheet conveying section has a sheet conveying path which is disposed at the anterior surface side of the apparatus main body, to convey the sheet therethrough, the front cover has a guide portion structuring a part of the sheet conveying path when the front cover is disposed at the closed position, and when the front cover is moved to the open position, the sheet conveying path is opened.

5. The image forming apparatus according to claim 1, further comprising:

a paper discharge tray which is provided at a superior surface of the apparatus main body, and to which a sheet after image formation is discharged, and a sheet discharge opening which is provided at a position at which an upper end side back surface of the front cover exists, and from which a sheet after image formation is discharged toward the paper discharge tray, wherein the release member is disposed at a peripheral portion of the sheet discharge opening.

6. The image forming apparatus according to claim 5, wherein the release members are disposed at a left side and a right side of the sheet discharge opening, which makes it possible to release the lock member by operating one of the release members.

7. The image forming apparatus according to claim 1, wherein the lock member is a lock member assembly supported by the front cover, the lock member assembly includes the following;:

a slide member which is a rod-like member having a first end portion and a second end portion, the slide member is capable of sliding by applying pressing force to the first end portion from the release member;

a rotary member with which the second end portion of the slide member is brought into contact, the rotary member rotates by the sliding;

a hook member which makes an engagement with and is detached from a predetermined engaging member provided to the apparatus main body; and a connecting member in a belt shape having a first connecting portion to be connected to the rotary member and a second connecting portion to be connected to the hook member.

8. The image forming apparatus according to claim 1, wherein the sheet conveying section has a sheet conveying path which is disposed at the anterior surface side of the apparatus main body, to convey the sheet therethrough, the image forming apparatus further comprising a conveying unit whose lower end side is supported swingablly by the apparatus main body, the conveying unit is capable of changing in position between a closed position to structure a part of the sheet conveying path by being interposed between the front cover disposed at the closed position and the anterior surface side of the apparatus main body, and an open position to open the sheet conveying path according to opening of the front cover.

9. The image forming apparatus according to claim 1, wherein the sheet conveying section has a sheet conveying path which is disposed at the anterior surface side of the apparatus main body, to convey the sheet therethrough, the image forming apparatus further comprising:

a conveying unit whose lower end side is supported pivotally by the apparatus main body, the conveying unit is capable of changing in position between a closed position to structure a part of the sheet conveying path by being interposed between the front cover disposed at the closed the closed position and the anterior surface side of the apparatus main body, and an open position to open the sheet conveying path according to opening of the front cover; and an engaging member provided to the apparatus main body, wherein the lock member is a lock member assembly including the following;

a shaft member which is installed along a horizontal direction at a side of the front cover, and the shaft member presses to position the conveying unit at the closed position when the front cover is moved from the open position to the closed position; and a hook member which is structured integrally with the shaft member, and is capable of making an engagement with and being detached from the engaging member, the hook member positions the front cover at the closed position at a time of engaging.

10. The image forming apparatus according to claim 9, wherein the conveying unit has a catching concave portion to position the conveying unit at the closed position by making an engagement with the shaft member in a state in which the front cover is disposed at the closed position.

11. The image forming apparatus according to claim 9, wherein the hook members are respectively installed at both ends of the shaft member, and the engaging members are installed at positions corresponding to the respective hook members at the side of the apparatus main body.

12. The image forming apparatus according to claim 10, wherein a cam portion formed at one of an entrance of the catching concave portion at the side of the conveying unit and the shaft member, and a cam follower portion formed at the other one are provided, and the cam portion and the cam follower portion are configured to rotate the hook member toward an engaging direction via the shaft member due to the cam portion and the cam follower portion contacting to have relative movement when the front cover is moved from the open position to the closed position.

13. The image forming apparatus according to claim 9, wherein the sheet conveying section has a first sheet conveying path structured between the conveying unit disposed at the closed position and the anterior surface side of the apparatus main body, and a second sheet conveying path, which is formed between the conveying unit disposed at the closed position and the front cover, to guide a sheet after image formation again to the image forming unit.

14. The image forming apparatus according to claim 1, further comprising:

an opening and closing aid mechanism which is installed between the apparatus main body and the front cover, to aid an opening and closing operation of the front cover; the opening and closing aid mechanism includes the following a guide member provided to project to a side surface of the front cover;

a holding link whose base end portion is supported pivotally by the apparatus main body, and which has a guide groove in a long hole shape to guide a movement of the guide member at a side of a leading end, the holding link holds the front cover at the open position by bringing the guide member into contact with the leading end of the guide groove; and an extension spring whose one end portion is connected to the side surface of the front cover, and whose other end portion is connected to the holding link, the extension spring biases the front cover toward a closing direction via the guide member by biasing the holding link.

15. The image forming apparatus according to claim 14, wherein with respect to the extension spring, the one end portion is connected to the upper end side of the front cover, and the other end portion is connected to the leading end side of the holding link.

16. The image forming apparatus according to claim 15, wherein an operating range of the extension spring is limited within an area occupied by the side surface at a time of facing to view the side surface of the front cover.

17. An image forming apparatus comprising:

an image forming unit which forms an image on a sheet;

a sheet conveying section which conveys the sheet on which the image is formed;

an apparatus main body in which the image forming unit and the sheet conveying section are installed;

a front cover which is supported in a freely openable/closable manner by the apparatus main body, the front cover is capable of changing in position between a closed position to cover an anterior surface side of the apparatus main body and an open position to expose a part of the apparatus main body; and a retention mechanism which includes a lock member and a release member, the retention mechanism retains the front cover at the closed position with respect to the apparatus main body, wherein the front cover has front face panels located at outer side surfaces, and the front face panels includes an anterior panel and an upper panel continuing to an upper end of the anterior panel, and the front cover is supported at its lower end side in a freely openable/closable manner by the apparatus main body, and is opened such that its upper end side is separated away from the apparatus main body at the open position, the lock member is a member which is supported by one of the apparatus main body and the front cover so as to be capable of making an engagement with and being detached from the other one, and the release member is a member to release engagement of the lock member, and the release member is installed at a back surface side of the upper panel as viewed from an opening and closing direction of the front cover.

18. An image forming apparatus comprising:

an image forming unit which forms an image on a sheet;

a sheet conveying section which conveys the sheet on which the image is formed;

an apparatus main body in which the image forming unit and the sheet conveying section are installed;

an operating unit to input operational information;

a front cover to which the operating unit is mounted to be supported in a freely openable/closable manner by the apparatus main body, the front cover is capable of changing in position between a closed position to cover an anterior surface side of the apparatus main body and an open position to expose a part of the apparatus main body; and a retention mechanism which includes a lock member and a release member, the retention mechanism retains the front cover at the closed position with respect to the apparatus main body, wherein the lock member is a member which is supported by one of the apparatus main body and the front cover so as to be capable of making an engagement with and being detached from the other one, the release member is a member to release engagement of the lock member, and the release member is installed at a region located posterior to the operating unit and a region facing a back surface side as viewed from an opening and closing direction of the front cover, the sheet conveying section has a sheet conveying path which is disposed at the anterior surface side of the apparatus main body, to convey the sheet therethrough, the front cover has a guide portion structuring a part of the sheet conveying path when the front cover is disposed at the closed position, and when the front cover is moved to the open position, the sheet conveying path is opened.

* * * * *